US012215685B2

(12) United States Patent
Jang et al.

(10) Patent No.: US 12,215,685 B2
(45) Date of Patent: Feb. 4, 2025

(54) SCROLL COMPRESSOR

(71) Applicant: LG ELECTRONICS INC., Seoul (KR)

(72) Inventors: Jinyong Jang, Seoul (KR); Sanghun Seong, Seoul (KR); Seokhwan Moon, Seoul (KR); Sooho Jang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/378,203

(22) Filed: Oct. 10, 2023

(65) Prior Publication Data

US 2024/0151227 A1 May 9, 2024

(30) Foreign Application Priority Data

Nov. 4, 2022 (KR) ..... 10-2022-0146159

(51) Int. Cl.
*F04C 18/02* (2006.01)
*F04C 23/00* (2006.01)
(Continued)

(52) U.S. Cl.
CPC ..... *F04C 18/0215* (2013.01); *F04C 18/0292* (2013.01); *F04C 23/008* (2013.01);
(Continued)

(58) Field of Classification Search
CPC ..... F04C 18/0215; F04C 18/0261; F04C 18/0292; F04C 23/008; F04C 28/12;
(Continued)

(56) References Cited

U.S. PATENT DOCUMENTS

2003/0012659 A1* 1/2003 Seibel ..... F04C 18/0215 418/55.4
2012/0107163 A1 5/2012 Monnier et al.
(Continued)

FOREIGN PATENT DOCUMENTS

| | | |
|---|---|---|
| CN | 109340117 | 2/2019 |
| KR | 10-2005-0028216 | 3/2005 |
| KR | 10-2018-0089774 | 8/2018 |

OTHER PUBLICATIONS

JP08261175A—Sano et al.—Scroll Compressor—Oct. 8, 1996—the English Machine Translation. (Year: 1996).*
(Continued)

*Primary Examiner* — Theresa Trieu
(74) *Attorney, Agent, or Firm* — KED & ASSOCIATES

(57) ABSTRACT

A scroll compressor is provided that may include a first back pressure unit that allows a refrigerant to flow from a first compression chamber to a back pressure chamber while blocking a reverse flow of the refrigerant, and a second back pressure unit that allows the refrigerant to flow from the back pressure chamber to a second compression chamber while blocking a reverse flow of the refrigerant. The first back pressure unit and the second back pressure unit may be spaced apart from each other in a direction that the compression chambers are formed. This may reduce pressure pulsation in the back pressure chamber. Also, leakage between compression chambers may be suppressed and simultaneously friction loss may be reduced by appropriately adjusting the pressure in the back pressure chamber. This is especially advantageous for enhancing compression efficiency under low load operating conditions (or in a low pressure ratio operation).

18 Claims, 11 Drawing Sheets

(51) Int. Cl.

| | |
|---|---|
| ***F04C 28/24*** | (2006.01) |
| ***F04C 28/26*** | (2006.01) |
| ***F04C 29/00*** | (2006.01) |
| ***F04C 29/12*** | (2006.01) |

(52) U.S. Cl.
CPC ..... *F04C 28/24* (2013.01); *F04C 29/0028* (2013.01); *F04C 29/0035* (2013.01); *F04C 29/126* (2013.01)

(58) Field of Classification Search
CPC ..... F04C 28/24; F04C 28/26; F04C 29/0028; F04C 29/0035; F04C 29/12; F04C 29/124; F04C 29/126
See application file for complete search history.

(56) References Cited

U.S. PATENT DOCUMENTS

| | | | | |
|---|---|---|---|---|
| 2015/0176585 | A1 | 6/2015 | Sun | |
| 2015/0345493 | A1 | 12/2015 | Lochner et al. | |
| 2018/0216618 | A1* | 8/2018 | Jeong | F04C 18/0215 |
| 2020/0088197 | A1* | 3/2020 | Kim | F04C 18/0215 |

OTHER PUBLICATIONS

Korean Office Action issued in Application No. 10-2022-0146159 dated Feb. 26, 2024.

* cited by examiner

SCROLL COMPRESSOR

CROSS-REFERENCE TO RELATED APPLICATION(S)

Pursuant to 35 U.S.C. § 119(a), this application claims the benefit of the earlier filing date and the right of priority to Korean Patent Application No. 10-2022-0146159, filed on Nov. 4, 2022, the contents of which are incorporated by reference herein in their entirety.

BACKGROUND

1 Field

A scroll compressor is disclosed herein.

2. Background

A scroll compressor is configured such that an orbiting scroll and a non-orbiting scroll are engaged with each other and a pair of compression chambers is formed between the orbiting scroll and the non-orbiting scroll while the orbiting scroll performs an orbiting motion with respect to the non-orbiting scroll. In the scroll compressor, as the pair of compression chambers is formed, leakage between the compression chambers may be suppressed only when the non-orbiting scroll and the orbiting scroll are sealed in close contact in an axial direction. Thus, the scroll compressor employs a back pressure structure which presses the orbiting scroll toward the non-orbiting scroll or presses the non-orbiting scroll toward the orbiting scroll. The former may be defined as an orbiting back pressure type, and the latter may be defined as a non-orbiting back pressure type.

The orbiting back pressure type is applied to a structure in which the non-orbiting scroll is fixed to a main frame. In the orbiting back pressure type, a back pressure chamber is formed between the orbiting scroll and the main frame supporting the orbiting scroll. On the other hand, the non-orbiting back pressure type is applied to a structure in which the non-orbiting scroll is axially movable relative to the main frame. In the non-orbiting back pressure type, a back pressure chamber is formed on a rear surface of the non-orbiting scroll. U.S. Patent Publication No. 2015/0345493 (hereinafter "Patent Document 1"), (U.S. Patent Publication No. 2012/0107163 (hereinafter "Patent Document 2"), and U.S. Patent Publication No. 2015/0176585 (hereinafter "Patent Document 3"), which are hereby incorporated by reference, each disclose a non-orbiting back pressure type scroll compressor. In these non-orbiting back pressure type scroll compressors, as the non-orbiting scroll is pressed toward the orbiting scroll by pressure in the back pressure chamber, it is advantageous in terms of efficiency of the compressor to maintain a difference between a pressure in the back pressure chamber and a pressure in the compression chamber as constantly as possible. This is especially true in low load operating conditions (or a low pressure ratio operation) in which a suction pressure of the compression chamber is lowered. Thus, a back pressure control device is required to change the pressure in the back pressure chamber in response to the pressure in the compression chamber.

However, in Patent Document 1, as only a structure for communicating between the compression chamber and the back pressure chamber is provided without any separate back pressure control device, it is impossible to change the pressure in the back pressure chamber, in response to the pressure in the compression chamber. As a result, the back pressure may rise excessively, thereby increasing friction loss between the non-orbiting scroll and the orbiting scroll, and causing compression loss due to the back pressure chamber acting as a kind of dead volume.

In Patent Document 2, a back pressure control device is provided, but it is only a unidirectional back pressure control device disposed between the back pressure chamber and a suction space. In other words, the back pressure control device is a device that exhausts some of a refrigerant of the back pressure chamber into the suction space when the pressure in the back pressure chamber rises excessively. However, in this case, as the refrigerant introduced into the back pressure chamber through the compression chamber leaks back into the suction space, suction loss is inevitable. In addition, as the compression chamber and the back pressure chamber always communicate with each other, pulsation is continuously generated in the back pressure chamber, so there may be a limit to maintaining the back pressure constantly.

In Patent Document 3, a back pressure control device is disposed between the compression chamber and the back pressure chamber. However, Patent Document 3 uses one back pressure control device to make a refrigerant move between the compression chamber and the back pressure chamber according to a pressure difference between the compression chamber and the back pressure chamber. That is, an introduction of the refrigerant into the back pressure chamber and an exhaust of the refrigerant from the back pressure chamber are made at one point (rotational angle). This may cause an increase in mechanical friction loss between the non-orbiting scroll and the orbiting scroll due to an excessive increase in the pressure of the back pressure chamber or deterioration of reliability due to an excessive increase in pressure (intermediate pressure) of the compression chamber.

BRIEF DESCRIPTION OF THE DRAWINGS

Embodiments will be described in detail with reference to the following drawings in which like reference numerals refer to like elements, and wherein.

DETAILED DESCRIPTION

Description will now be given in detail of a scroll compressor according to exemplary embodiments disclosed herein, with reference to the accompanying drawings.

Typically, a scroll compressor may be classified as an open type or a hermetic type depending on whether a drive unit (motor unit) and a compression unit are all installed in an inner space of a casing. The former is a compressor in which the motor unit configuring the drive unit is provided separately from the compression unit, and the latter hermetic type is a compressor in which both the motor unit and the compression unit are disposed inside of the casing. Hereinafter, a hermetic type scroll compressor will be described as an example, but it is not necessarily limited to the hermetic scroll compressor. In other words, embodiments may be equally applied even to the open type scroll compressor in which the motor unit and the compression unit are disposed separately from each other.

In addition, scroll compressors may be classified into a vertical scroll compressor in which a rotary shaft is disposed perpendicular to the ground and a horizontal (lateral) scroll compressor in which the rotary shaft is disposed parallel to the ground. For example, in the vertical scroll compressor, an upper side may be defined as an opposite side to the ground and a lower side may be defined as a side facing the ground. Hereinafter, the vertical scroll compressor will be described as an example. However, embodiments may also be equally applied to the horizontal scroll compressor. Hereinafter, it will be understood that an axial direction is an axial direction of the rotary shaft, a radial direction is a radial direction of the rotary shaft, the axial direction is an upward and downward (or vertical) direction, and the radial direction is a left and right or lateral direction, respectively.

Figure 1:
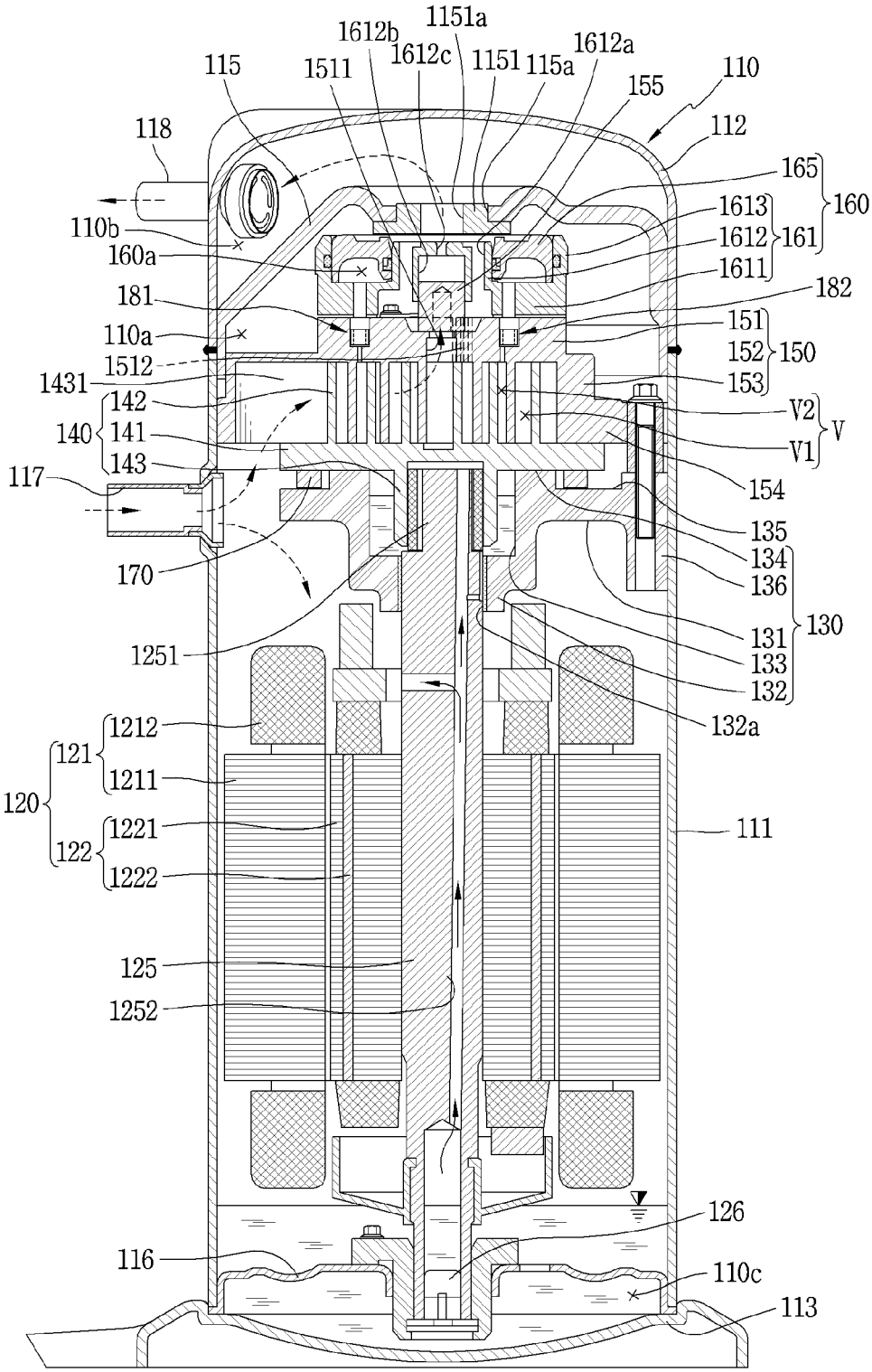
FIG. 1 is a longitudinal cross-sectional view of a scroll compressor in accordance with an embodiment.
Figure 2:
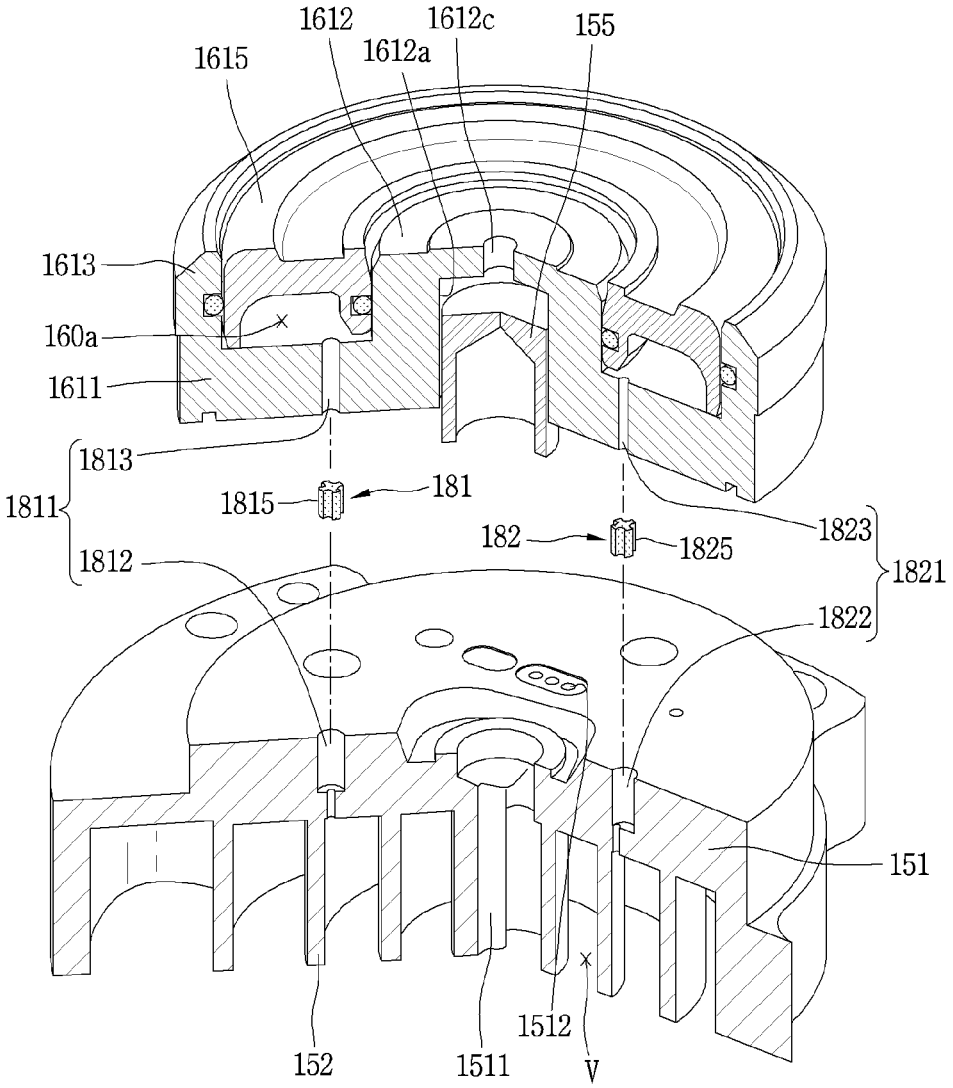
FIG. 2 is an exploded perspective view of a non-orbiting scroll and a back pressure chamber assembly in FIG. 1 according to an embodiment.

FIG. 1 is a longitudinal cross-sectional view illustrating an inner structure of a scroll compressor in accordance with an embodiment. FIG. 2 is an exploded perspective view of a non-orbiting scroll and a back pressure chamber assembly in FIG. 1 according to an embodiment.

Referring to FIG. 1, a scroll compressor according to an embodiment may include a drive motor 120 disposed in or at a lower half portion of a casing 110, and a main frame 130, an orbiting scroll 140, a non-orbiting scroll 150, and a back pressure chamber assembly 160 that constitute a compression unit disposed above the drive motor 120. The motor unit is coupled to one (first) end of a rotary shaft 125, and the compression unit is coupled to another (second) end of the rotary shaft 125. Accordingly, the compression unit may be connected to the motor unit by the rotary shaft 125 to be operated by a rotational force of the motor unit.

The casing 110 may include a cylindrical shell 111, an upper cap 112, and a lower cap 113. The cylindrical shell 111 has a cylindrical shape with upper and lower ends open, and the drive motor 120 and the main frame 130 is fitted on an inner circumferential surface of the cylindrical shell 111. A terminal bracket (not illustrated) may be coupled to an upper half portion of the cylindrical shell 111. A terminal (not illustrated) that transmits external power to the drive motor 120 may be coupled through the terminal bracket. In addition, a refrigerant suction pipe 117 discussed hereinafter may be coupled to an upper portion of the cylindrical shell 111, for example, above the drive motor 120.

The upper cap 112 may be coupled to cover the open upper end of the cylindrical shell 111. The lower cap 113 is coupled to cover a lower opening of the cylindrical shell 111. A rim of a high/low pressure separation plate 115 discussed hereinafter is inserted between the cylindrical shell 111 and the upper cap 112 to be, for example, welded on the cylindrical shell 111 and the upper cap 112. A rim of a support bracket 116 discussed hereinafter may be inserted between the cylindrical shell 111 and the lower cap 113 to be, for example, welded on the cylindrical shell 111 and the lower cap 113. Accordingly, the inner space of the casing 110 may be sealed.

The rim of the high/low pressure separation plate 115 may be welded on the casing 110 as described above. A central portion of the high/low pressure separation plate 115 may be bent and protrude toward an upper surface of the upper cap 112 so as to be disposed above the back pressure chamber assembly 160 discussed hereinafter. The refrigerant suction pipe 117 may communicate with a space below the high/low pressure separation plate 115, and a refrigerant discharge pipe 118 may communicate with a space above the high/low pressure separation plate 115. Accordingly, a low-pressure part or portion 110*a* constituting a suction space may be formed below the high/low pressure separation plate 115, and a high-pressure part or portion 110*b* constituting a discharge space may be formed above the high/low pressure separation plate 115.

In addition, a through hole 115*a* may be formed through a center of the high/low pressure separation plate 115. A sealing plate 1151 from which a floating plate 165 discussed hereinafter may be detachable is inserted into the through hole 115*a*. The low-pressure portion 110*a* and the high-pressure portion 110*b* may be blocked from each other by attachment/detachment of the floating plate 165 and the sealing plate 1151 or may communicate with each other through a high/low pressure communication hole 1151*a* of the sealing plate 1151.

In addition, the lower cap 113 may define an oil storage space 110*c* together with a lower portion of the cylindrical shell 111 constituting the low-pressure portion 110*a*. In other words, the oil storage space 110*c* is defined in the lower portion of the low-pressure portion 110*a*. The oil storage space 110*c* thus defines a part or portion of the low-pressure portion 110*a*.

Referring to FIG. 1, the drive motor 120 according to an embodiment may be disposed in a lower half portion of the low-pressure portion 110*a* and include a stator 121 and a rotor 122. The stator 121 may be, for example, shrink-fitted to an inner wall surface of the casing 111, and the rotor 122 may be rotatably provided inside of the stator 121.

The stator 121 may include a stator core 1211 and a stator coil 1212. The stator core 1211 may be formed in a cylindrical shape and, for example, shrink-fitted onto an inner circumferential surface of the cylindrical shell 111. The stator coil 1212 may be wound around the stator core 1211 and may be electrically connected to an external power source through a terminal (not illustrated) that is coupled through the casing 110.

The rotor 122 may include a rotor core 1221 and permanent magnets 1222. The rotor core 1221 may be formed in a cylindrical shape, and rotatably inserted into the stator core 1211 with a preset or predetermined gap therebetween. The permanent magnets 1222 may be embedded in the rotor core 1222 at preset or predetermined intervals along a circumferential direction.

In addition, the rotary shaft 125 may be, for example, press-fitted to a center of the rotor core 1221. An orbiting scroll 140 discussed hereinafter may be eccentrically coupled to an upper end of the rotary shaft 125. Accordingly, a rotational force of the drive motor 120 may be transmitted to the orbiting scroll 140 through the rotary shaft 125.

An eccentric portion 1251 that is eccentrically coupled to the orbiting scroll 140 discussed hereinafter may be formed on an upper end of the rotary shaft 125. An oil pickup 126 that suctions up oil stored in the lower portion of the casing 110 may be disposed in or at a lower end of the rotary shaft 125. An oil passage 1252 may be formed through an inside of the rotary shaft 125 in the axial direction.

Referring to FIG. 1, the main frame 130 may be disposed on or at an upper side of the drive motor 120, and may be, for example, shrink-fitted to or welded on an inner wall surface of the cylindrical shell 111. The main frame 130 may include a main flange portion 131, a main bearing portion 132, an orbiting space portion 133, a scroll support portion 134, an Oldham ring support portion 135, and a frame fixing portion 136.

The main flange portion 131 may be formed in an annular shape and accommodated in the low-pressure portion 110*a* of the casing 110. An outer diameter of the main flange portion 131 may be smaller than an inner diameter of the cylindrical shell 111 so that an outer circumferential surface of the main flange portion 131 is spaced apart from an inner circumferential surface of the cylindrical shell 111. However, the frame fixing portion 136 discussed hereinafter may protrude from the outer circumferential surface of the main flange portion 131 in a radial direction. The outer circumferential surface of the frame fixing portion 136 may be fixed in close contact with the inner circumferential surface of the casing 110. Accordingly, the frame 130 may be fixedly coupled to the casing 110.

The main bearing portion 132 may protrude downward from a lower surface of a central part or portion of the main flange portion 131 toward the drive motor 120. A bearing hole 132*a* formed in a cylindrical shape penetrates through the main bearing portion 132 in the axial direction. The rotary shaft 125 may be inserted into an inner circumferential surface of the bearing hole 132*a* and supported in the radial direction.

The orbiting space portion 133 may be recessed from the center portion of the main flange portion 131 toward the main bearing portion 132 to have a predetermined depth and outer diameter. The outer diameter of the orbiting space portion 133 may be larger than an outer diameter of a rotary shaft coupling portion 143 that is disposed on the orbiting scroll 140 discussed hereinafter. Accordingly, the rotary shaft coupling portion 143 may be pivotally accommodated in the orbiting space portion 133.

The scroll support portion 134 may be formed in an annular shape on an upper surface of the main flange portion 131 along a circumference of the orbiting space portion 133. Accordingly, the scroll support portion 134 may support a lower surface of an orbiting end plate 141 discussed hereinafter in the axial direction.

The Oldham ring support portion 135 may be formed in an annular shape on an upper surface of the main flange portion 131 along an outer circumferential surface of the scroll support portion 134. Accordingly, an Oldham ring 170 may be inserted into the Oldham ring supporting portion 135 to be pivotable.

The frame fixing portion 136 may extend radially from an outer circumference of the Oldham ring support portion 135. The frame fixing portion 136 may extend in an annular shape or extend to form a plurality of protrusions spaced apart from one another by preset or predetermined distances. This embodiment illustrates an example in which the frame fixing portion 136 has a plurality of protrusions along the circumferential direction.

Referring to FIG. 1, the orbiting scroll 140 according to this embodiment is coupled to the rotary shaft 125 to be disposed between the main frame 130 and the non-orbiting scroll 150. The Oldham ring 170, which is an anti-rotation mechanism, is disposed between the main frame 130 and the orbiting scroll 140. Accordingly, the orbiting scroll 140 performs an orbiting motion relative to the non-orbiting scroll 150 while its rotational motion is restricted.

The orbiting scroll 140 may include the orbiting end plate 141, an orbiting wrap 142, and the rotary shaft coupling portion 143. The orbiting end plate 141 may be formed approximately in a disk shape. An outer diameter of the orbiting end plate 141 may be mounted on the scroll support portion 134 of the main frame 130 to be supported in the axial direction. Accordingly, the orbiting end plate 141 and the scroll support portion 134 facing it defines an axial bearing surface (no reference numeral given).

The orbiting wrap 142 may be formed in a spiral shape by protruding from an upper surface of the orbiting end plate 141 facing the non-orbiting scroll 150 to a preset or predetermined height. The orbiting wrap 142 may correspond to the non-orbiting wrap 152 to perform an orbiting motion by being engaged with a non-orbiting wrap 152 of the non-orbiting scroll 150 discussed hereinafter. The orbiting wrap 142 defines compression chambers V together with the non-orbiting wrap 152.

The compression chambers V may include first compression chamber V1 and second compression chamber V2 based on the orbiting wrap 142. Each of the first compression chamber V1 and the second compression chamber V2 may include a suction pressure chamber (not illustrated), an intermediate pressure chamber (not illustrated), and a discharge pressure chamber (not illustrated) that are continuously formed. Hereinafter, description will be given under assumption that a compression chamber defined between an outer surface of the orbiting wrap 142 and an inner surface of the non-orbiting wrap 152 facing the same is defined as the first compression chamber V1, and a compression chamber defined between an inner surface of the orbiting wrap 142 and an outer surface of the non-orbiting wrap 152 facing the same is defined as the second compression chamber V2.

The rotary shaft coupling portion 143 may protrude from the lower surface of the orbiting end plate 141 toward the main frame 130. The rotary shaft coupling portion 143 may be formed in a cylindrical shape, so that an orbiting bearing (not illustrated) configured as a bush bearing may be, for example, press-fitted thereto.

Referring to FIG. 1, the non-orbiting scroll 150 according to this embodiment is disposed on an upper portion of the main frame 130 with the orbiting scroll 140 interposed therebetween. The non-orbiting scroll 150 may be fixedly coupled to the main frame 130 or may be coupled to the main frame 130 to be movable up and down. The embodiment illustrates an example in which the non-orbiting scroll 150 is coupled to the main frame 130 to be movable relative to the main frame 130 in the axial direction.

Referring to FIGS. 1 and 2, the non-orbiting scroll 150 according to this embodiment may include a non-orbiting end plate portion 151, the non-orbiting wrap 152, a non-orbiting side wall portion 153, and a guide protrusion 154. The non-orbiting end plate portion 151 may be formed in a disk shape and disposed in a lateral direction in the low-pressure portion 110*a* of the casing 110. A discharge port 1511, a bypass hole 1512, and a plurality of scroll back pressure holes 1812 and 1822 defining a part or portion of a back pressure part or portion 181 and 182 discussed hereinafter may be formed through a central portion of the non-orbiting end plate portion 151 in the axial direction.

The single discharge port 1511 may be formed such that discharge pressure chambers (no reference numerals given) of both compression chambers V1 and V2 formed at inner and outer sides of the non-orbiting wrap 152 communicate with each other. However, in some cases, the discharge port 1511 may be provided as a plurality to communicate with the compression chambers V1 and V2 independently.

The bypass holes 1512 may independently communicate with both compression chambers V2. In other words, the bypass hole 1512 may be formed closer to a suction side than the discharge port 1511, and may be disposed at one position for each compression chamber V1 and V2. However, in some cases, the bypass holes 1512 may be formed at a plurality of positions for each compression chamber V1 and V2 at predetermined distances along a formation direction of the compression chambers V1 and V2. Although three bypass holes are illustrated in the drawing, hereinafter, it will be defined and described as being formed at one position.

The plurality of scroll back pressure holes 1812 and 1822 may be formed at positions spaced apart from the discharge port 1511 and the bypass holes 1512, respectively. In other words, the first scroll back pressure hole 1812 and the second scroll back pressure hole 1822 may be formed closer to a suction side than the bypass hole 1512. Accordingly, the discharge port 1511, the first bypass hole 1512, and the scroll back pressure holes 1812 and 1822 may be formed sequentially from a discharge side to the suction side in the non-orbiting end plate portion 151.

However, in some cases, portions of the scroll back pressure holes 1812 and 1822 may be formed between the discharge port 1511 and the bypass hole 1512. This embodiment will be described focusing on an example in which each of the first scroll back pressure hole 1812 and the second scroll back pressure hole 1822 is formed closer to the suction side than the bypass hole 1512.

In addition, the plurality of scroll back pressure holes 1812 and 1822 may be formed independently in both compression chambers V1 and V2, respectively, but may alternatively be formed to communicate only with one compression chamber of the compression chambers V1 and V2. This embodiment shows an example in which the plurality of scroll back pressure holes are formed to communicate with only one compression chamber of both the compression chambers V1 and V2.

In addition, the plurality of scroll back pressure holes may be opened and closed in opposite directions. For example, first back pressure valve 1815 may be disposed in the first scroll back pressure hole 1812 to allow movement of refrigerant from the compression chamber V to the back pressure chamber 160*a* while restricting reverse movement of the refrigerant, and second back pressure valve 1825 may be disposed in the second scroll back pressure hole 1822 to allow movement of refrigerant from the back pressure chamber 160*a* to the compression chamber V while restricting reverse movement of the refrigerant. The first scroll back pressure hole 1812 and the second scroll back pressure hole 1822 will be described again together with the back pressure valves 1815 and 1825 hereinafter.

The non-orbiting wrap 152 extends from a lower surface of the non-orbiting end plate portion 151 facing the orbiting scroll 140 by a preset or predetermined height in the axial direction. The non-orbiting wrap 142 extends to be spirally rolled a plurality of times toward the non-orbiting side wall portion 153 in the vicinity of the discharge port 1511. The non-orbiting wrap 152 may be formed to correspond to the orbiting wrap 142, so as to define a pair of compression chambers V with the orbiting wrap 142.

The non-orbiting side wall portion 153 may extend in an annular shape from a rim of the lower surface of the non-orbiting end plate portion 151 in the axial direction to surround the non-orbiting wrap 152. A suction port 1531 may be formed through one side of an outer circumferential surface of the non-orbiting side wall portion 153 in the radial direction.

The guide protrusion 154 may extend radially from an outer circumferential surface of a lower side of the non-orbiting side wall portion 153. The guide protrusion 154 may be formed in a single annular shape or may be provided as a plurality disposed at preset or predetermined distances in the circumferential direction. This embodiment will be mainly described based on an example in which the plurality of guide protrusions 154 is disposed at preset or predetermined distances along the circumferential direction.

Referring to FIGS. 1 and 2, the back pressure chamber assembly 160 according to this embodiment is disposed at an upper side of the non-orbiting scroll 150. Accordingly, a back pressure of a back pressure chamber 160*a* (more specifically, a force with which the back pressure acts on the back pressure chamber) is applied to the non-orbiting scroll 150. In other words, the non-orbiting scroll 150 is pressed toward the orbiting scroll 140 by the back pressure to seal the compression chambers V1 and V2.

The back pressure chamber assembly 160 may include a back pressure plate 161 and a floating plate 165. The back pressure plate 161 may be coupled to an upper surface of the non-orbiting end plate 151. A floating plate 165 may be slidably coupled to the back pressure plate 161 to define the back pressure chamber 160*a* together with the back pressure plate 161. The back pressure plate 161 may include a fixed plate portion 1611, a first annular wall portion 1612, and a second annular wall portion 1613.

A plurality of plate back pressure holes 1813 and 1823 may be formed through the fixed end plate portion 1611 in the axial direction. The plurality of plate back pressure holes 1813 and 1823 may communicate with the compression chamber V through the plurality of scroll back pressure holes 1812 and 1822, respectively. Accordingly, the compression chamber V and the back pressure chamber 160*a* communicate with each other through the plate back pressure holes 1813 and 1823 and the scroll back pressure holes 1812 and 1822.

The plate back pressure holes 1813 and 1823 may be formed to correspond to the previously described scroll back pressure holes 1812 and 1822. For example, the first plate back pressure hole 1813 may communicate with the first scroll back pressure hole 1812, while the second plate back pressure hole 1823 may communicate with the second scroll back pressure hole 1822. The first plate back pressure hole 1813 and the second plate back pressure hole 1823 will be described hereinafter again together with the first scroll back pressure hole 1812 and the second scroll back pressure hole 1822.

The first annular wall portion 1612 and the second annular wall portion 1613 may be formed on an upper surface of the fixed plate portion 1611 to surround inner and outer circumferential surfaces of the fixed plate portion 1611. Accordingly, the back pressure chamber 160*a* formed in the annular shape is defined by an outer circumferential surface of the first annular wall portion 1612, an inner circumferential surface of the second annular wall portion 1613, the upper surface of the fixed plate portion 1611, and a lower surface of the floating plate 165.

The first annular wall portion 1612 may include an intermediate discharge port 1612*a* that communicates with the discharge port 1511 of the non-orbiting scroll 150. A valve guide groove 1612*b* into which a discharge valve 155 is slidably inserted may be formed at an inner side of the intermediate discharge port 1612*a*. A backflow prevention hole 1612*c* may be formed in or at a center of the valve guide groove 1612*b*. Accordingly, the discharge valve 155 may be selectively opened and closed between the discharge port 1511 and the intermediate discharge port 1612*a* to suppress discharged refrigerant from flowing back into the compression chambers V1 and V2.

The floating plate 165 may be formed in an annular shape. The floating plate 165 may be formed of a lighter material than the back pressure plate 161. Accordingly, the floating plate 165 may be detachably coupled to a lower surface of the high/low pressure separation plate 115 while moving in the axial direction with respect to the back pressure plate 161 depending on the pressure of the back pressure chamber 160*a*. For example, when the floating plate 165 is brought into contact with the high/low pressure separation plate 115, the floating plate 165 serves to seal the low-pressure portion 110*a* such that the discharged refrigerant is discharged to the high-pressure portion 110*b* without leaking into the low-pressure portion 110*a*.

The scroll compressor according to an embodiment may operate as follows.

That is, when power is applied to the drive motor 120 and the rotational force is generated, the orbiting scroll 140 eccentrically coupled to the rotary shaft 125 performs an orbiting motion relative to the non-orbiting scroll 150 by the Oldham ring 170. During this process, the first compression chamber V1 and the second compression chamber V2 that continuously move are formed between the orbiting scroll 140 and the non-orbiting scroll 150. Then, the first compression chamber V1 and the second compression chamber V2 are gradually reduced in volume as they move from the suction port (or suction chamber) 1531 to the discharge port (or discharge chamber) 1511 during the orbiting motion of the orbiting scroll 140.

Accordingly, refrigerant is suctioned into the low-pressure portion 110*a* of the casing 110 through the refrigerant suction pipe 117. Some of this refrigerant is suctioned directly into the suction pressure chambers (no reference numerals given) of the first compression chamber V1 and the second compression chamber V2, respectively, while the remaining refrigerant first flows toward the drive motor 120 to cool down the drive motor 120 and then is suctioned into the suction pressure chambers (no reference numerals given).

Then, the refrigerant is compressed while moving along moving paths of the first compression chamber V1 and the second compression chamber V2. The compressed refrigerant partially flows into the back pressure chamber 160*a* formed by the back pressure plate 161 and the floating plate 165 through the first back pressure hole 1811 and the second back pressure hole 1821 before reaching the discharge port 1511. Accordingly, the back pressure chamber 160*a* forms an intermediate pressure.

The floating plate 165 then rises toward the high/low pressure separation plate 115 to be brought into close contact with the sealing plate 1151 provided on the high/low pressure separation plate 115. The high-pressure portion 110*b* of the casing 110 is separated from the low-pressure portion 110*a*, to prevent the refrigerant discharged from each compression chamber V1 and V2 from flowing back into the low-pressure portion 110*a*.

On the other hand, the back pressure plate 161 is pressed down toward the non-orbiting scroll 150 by the pressure of the back pressure chamber 160*a*. The non-orbiting scroll 150 is pressed toward the orbiting scroll 140. Accordingly, the non-orbiting scroll 150 may be brought into close contact with the orbiting scroll 140, thereby preventing the refrigerant inside of both compression chambers from leaking from a high-pressure compression chamber forming an intermediate pressure chamber to a low-pressure compression chamber.

The refrigerant is compressed to a set pressure while moving from the intermediate pressure chamber toward a discharge pressure chamber. This refrigerant moves to the discharge port 1511 and presses the discharge valve 155 in an opening direction. Responsive to this, the discharge valve 155 is pushed up along the valve guide groove 1612*b* by the pressure of the discharge pressure chamber, so as to open the discharge port 1511. The refrigerant in the discharge pressure chamber flows to the high-pressure portion 110*b* through the discharge port 1511 and the intermediate discharge port 1612*a* disposed in the back pressure plate 161.

On the other hand, as described above, in the related art scroll compressors, an example is shown in which a separate back pressure control device is not disposed between the compression chamber V and the back pressure chamber 160*a*, or even if the back pressure control device is provided, it is unidirectional to allow refrigerant movement only from the compression chamber to the back pressure chamber 160*a*, or even if the back pressure control device is bidirectional, it allows refrigerant movement only at one point. For this reason, there may be a limit to effectively reducing pressure pulsation in the back pressure chamber 160*a*, and even if the pressure pulsation in the back pressure chamber 160*a* is reduced, a deterioration of efficiency in the compression chamber may occur.

Therefore, this embodiment may include (first) back pressure unit 181 that allows only the movement of refrigerant from the compression chamber V to the back pressure chamber 160*a*, and (second) back pressure unit 182 that allows, in an opposite way to the back pressure unit 181, only the movement of refrigerant from the back pressure chamber 160*a* to the compression chamber V. The back pressure units 181 and 182 may be disposed independently of each other to lower pressure pulsation in the back pressure chamber 160*a* and simultaneously suppress a deterioration of compression efficiency in the compression chamber V.

Figure 3:
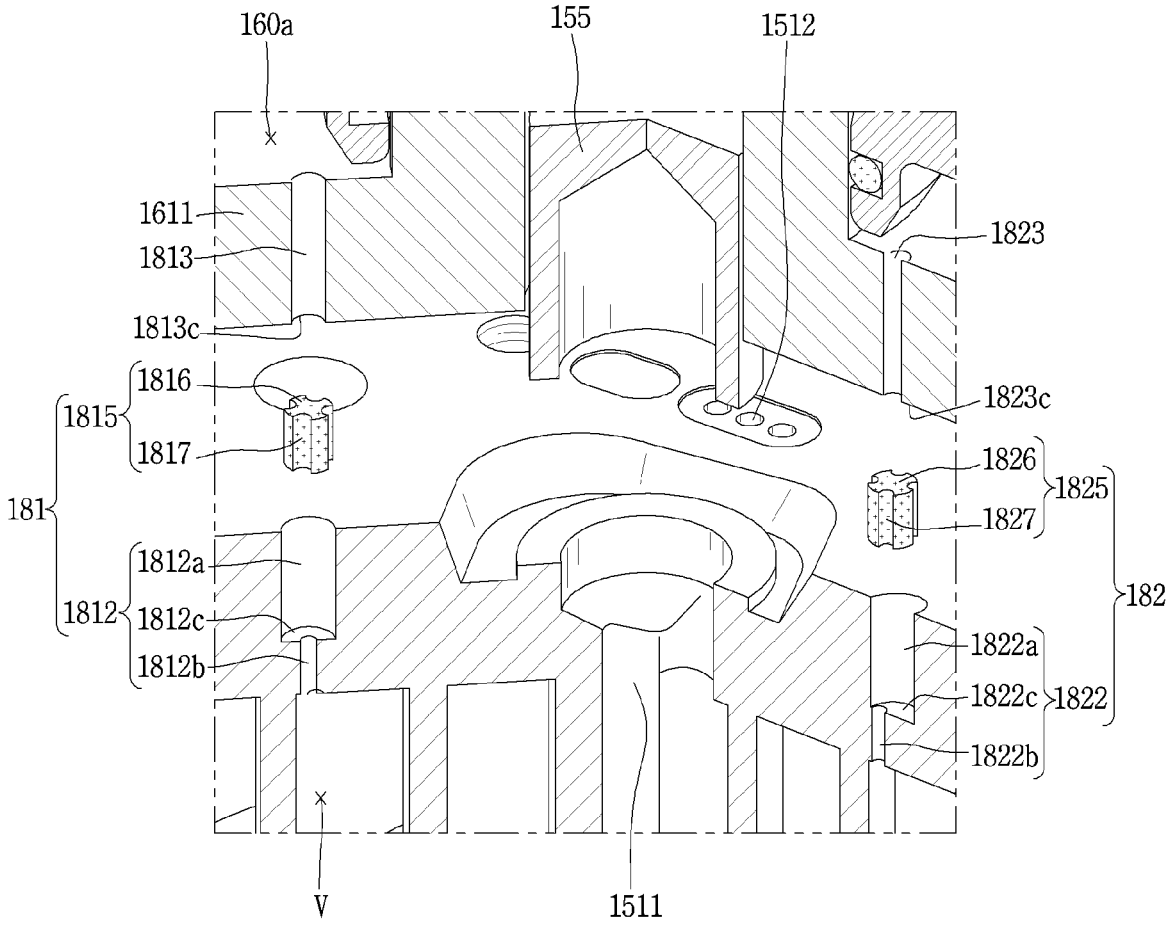
FIG. 3 is an enlarged perspective view of a portion of the non-orbiting scroll and the back pressure chamber assembly in FIG. 2.
Figure 4:
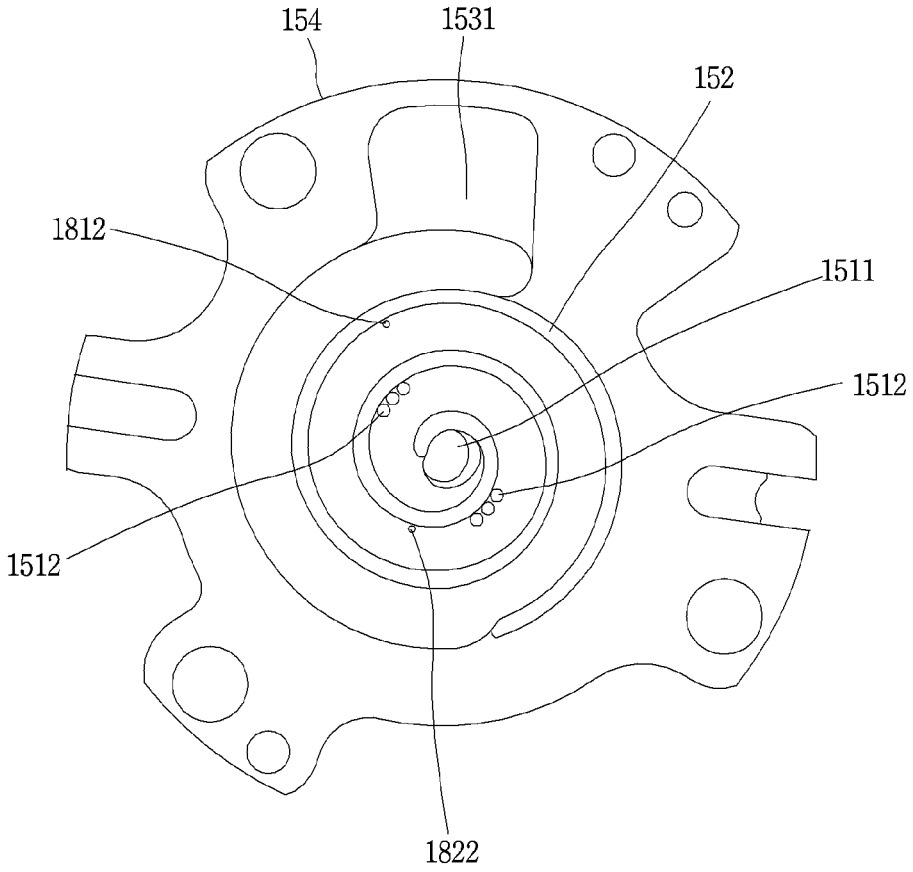
FIG. 4 is a planar view of the non-orbiting scroll, viewed from a bottom, for explaining positions of a first back pressure unit and a second back pressure unit in accordance with an embodiment.

FIG. 3 is an enlarged perspective view of a portion of the non-orbiting scroll and the back pressure chamber assembly of FIG. 2. FIG. 4 is a planar view of the non-orbiting scroll, viewed from a bottom, for explaining positions of a first back pressure unit and a second back pressure unit in accordance with an embodiment.

Referring to FIGS. 1 and 2 again, as described above, the scroll compressor according to an embodiment is configured as the non-orbiting back pressure type in which the back pressure chamber assembly 160 is coupled to the rear surface of the non-orbiting scroll 150 to press the non-orbiting scroll 150 toward the orbiting scroll 140. In this case, the compression chambers V1 and V2 are formed between the orbiting scroll 140 and the non-orbiting scroll 150, the back pressure chamber 160*a* is formed between the back pressure plate 161 and the floating plate 165 defining the back pressure chamber assembly 160, and the compression chambers V1 and V2 and the back pressure chamber 160*a* communicate with each other through the plurality of back pressure units 181 and 182 that include the plurality of scroll back pressure holes 1812 and 1822 and the plurality of plate back pressure holes 1813 and 1823. Referring to FIGS. 3 and 4, the plurality of back pressure units 181 and 182 may include first back pressure unit 181 and second back pressure unit 182. The first back pressure unit 181 and the second back pressure unit 182 are spaced apart from each other by a predetermined distance along the formation direction of the compression chamber V. In other words, the first back pressure unit 181 and the second back pressure unit 182 are formed independently of each other. A back pressure unit at a suction side where a relatively low pressure is formed may be defined as the first back pressure unit 181 and a back pressure unit at a discharge side where a high pressure is formed may be defined as the second back pressure unit 182, with respect to the formation direction of the compression chamber V.

The first back pressure unit 181 allows refrigerant in the compression chamber V to move to the back pressure chamber 160*a* while blocking movement of the refrigerant in a reverse (opposite) direction. The second back pressure unit 182 allows refrigerant in the back pressure chamber 160*a* to move to the compression chamber V while blocking movement of the refrigerant in the reverse direction. In other words, the first back pressure unit 181 and the second back pressure unit 182 are configured as unidirectional opening and closing devices, and allow movement of refrigerant in opposite directions.

In addition, the first back pressure unit 181 and the second back pressure unit 182 communicate with compression chambers V each having a different pressure. The first back pressure unit 181 may communicate with a compression chamber V having a pressure relatively lower than a pressure of another compression chamber V with which the second back pressure unit 182 communicates. Accordingly, the first back pressure unit 181 may be disposed to be as close to a suction completion angle as possible to form a recompression suppressing unit (or back pressure forming operation unit), while the second back pressure unit 182 may be disposed to be as close to the discharge port 1511 as possible to form a back pressure reducing unit (or back pressure relieving operation unit).

For example, when the suction completion angle is 0°, the first back pressure unit 181 may be formed to be located within a rotational angle range from 0° to 250° immediately after the compression chamber V completes a suction stroke. On the other hand, the second back pressure unit 182 may be formed within a range of an angle at which it does not overlap the first back pressure unit 181, namely, a range from 255° to a discharge completion angle. In other words, it is sufficient that the first back pressure unit 181 does not overlap the second back pressure unit 182, but it is advantageous in terms of back pressure formation that the first back pressure unit 181 is formed, if possible, after a rotational angle at which a suction stroke is completed. In addition, it is sufficient that the second back pressure unit 182 is formed at any rotational angle at which it does not overlap the first back pressure unit 181, but it is advantageous in terms of suppressing a pressure change in the compression chamber V due to the back pressure that the second back pressure unit 182 is formed within a range of a rotational angle at which a discharge stroke is carried out.

In addition, the first back pressure unit 181 and the second back pressure unit 182 may be disposed in the same member, that is, the non-orbiting scroll 150 and/or the back pressure chamber assembly 160, or may be disposed in different members 150 and 160, respectively. Hereinafter, description will be given of an example in which the first back pressure unit 181 and the second back pressure unit 182 are disposed in the same member, for example, in any one of the non-orbiting scroll 150 or the back pressure chamber assembly 160.

Figure 5:
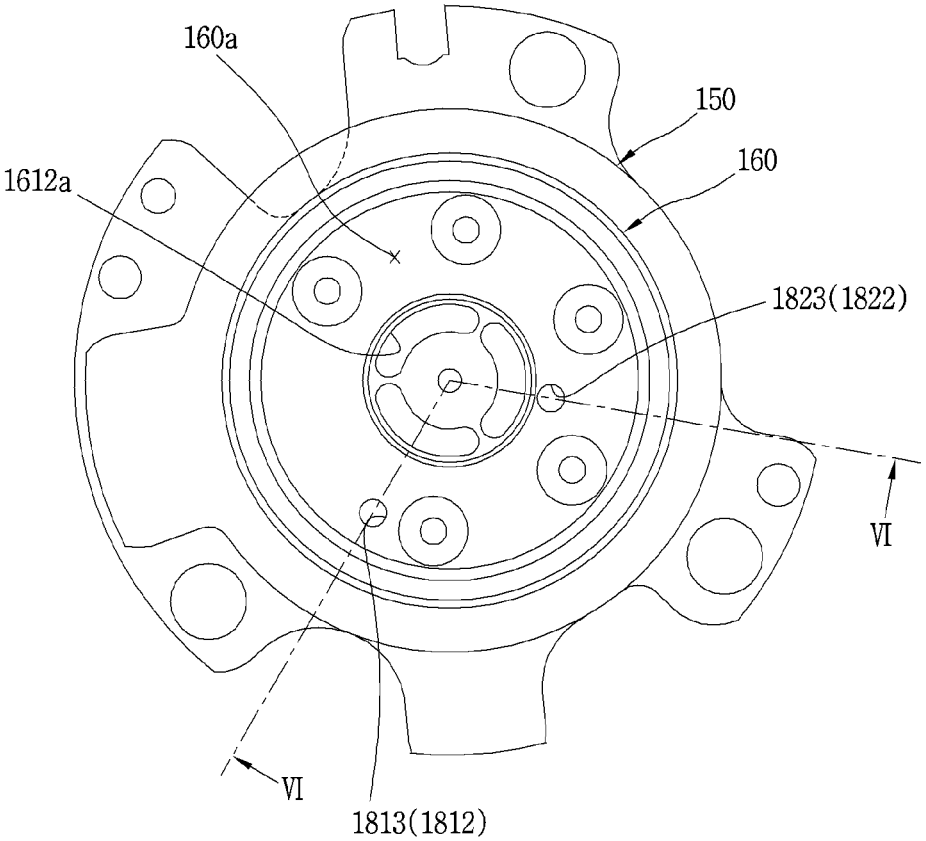
FIG. 5 is a planar view, viewed from a top, illustrating a non-orbiting scroll and a back pressure chamber assembly in an assembled state in accordance with an embodiment.
Figure 6:
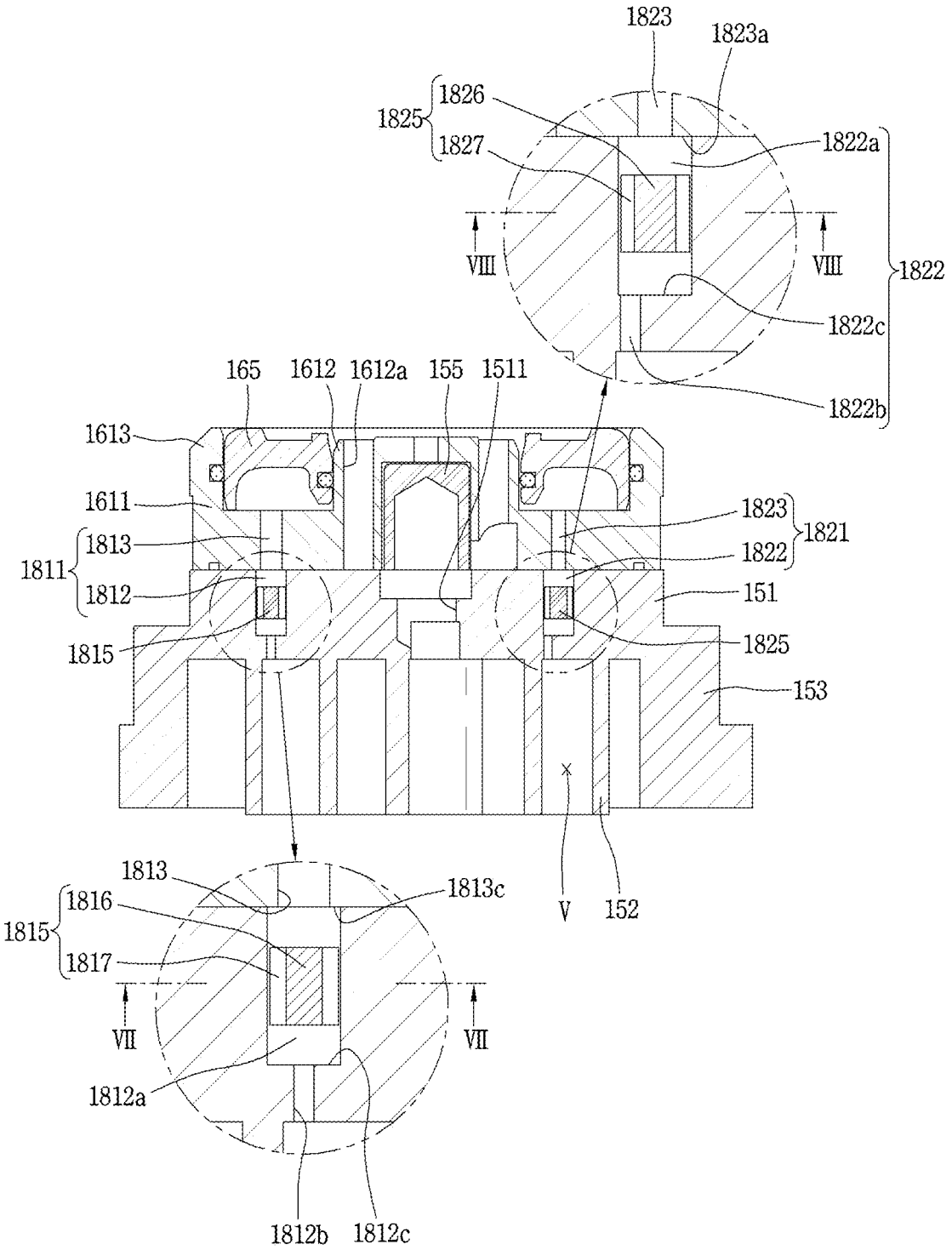
FIG. 6 is a cross-sectional view, taken along line "VI-VI" of FIG. 5.
Figure 7:
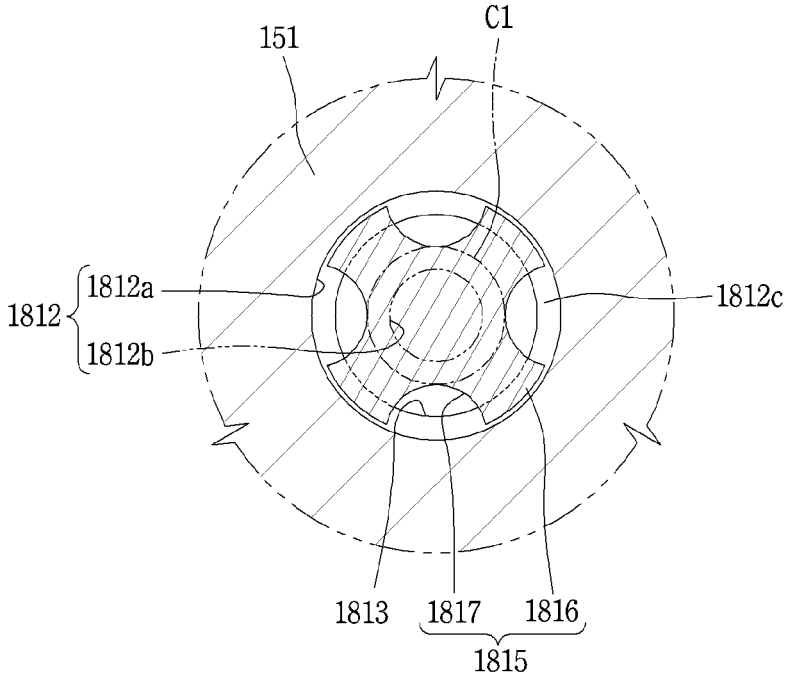
FIG. 7 is a cross-sectional view, taken along line "VII-VII" of FIG. 6.
Figure 8:
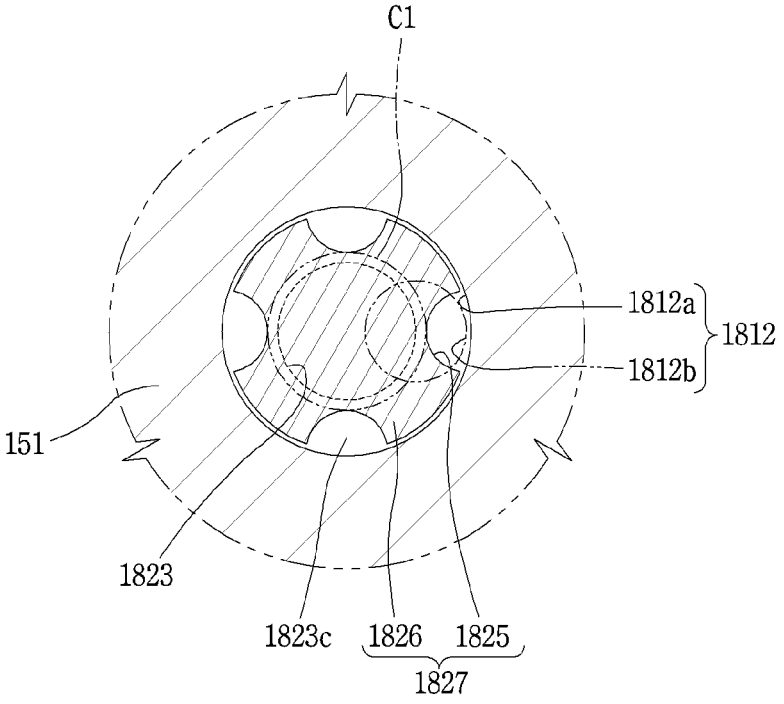
FIG. 8 is a cross-sectional view, taken along line "VIII-VIII" of FIG. 6.

FIG. 5 is a planar view, viewed from a top, illustrating a non-orbiting scroll and a back pressure chamber assembly in an assembled state in accordance with an embodiment. FIG. 6 is a cross-sectional view, taken along line "VI-VI" of FIG. 5. FIG. 7 is a cross-sectional view, taken along line "VII-VII" of FIG. 6. FIG. 8 is a cross-sectional view, taken along line "VIII-VIII" of FIG. 6.

Referring to FIGS. 5 and 6, the first back pressure unit 181 according to this embodiment may include a first back pressure hole 1811 and a first back pressure valve 1815. The first back pressure hole 1811 may include first scroll back pressure hole 1812 disposed in the non-orbiting end plate portion 151, and first plate back pressure hole 1813 disposed in the back pressure plate 161. In other words, the first scroll back pressure hole 1812 may be formed through the non-orbiting end plate portion 151 in the axial direction. The first plate back pressure hole 1813 may be formed through the back pressure plate 161 in the axial direction such that one end thereof communicates with one end of the first scroll back pressure hole 1812. Accordingly, the first scroll back pressure hole 1812 and the first plate back pressure hole 1813 may be formed to communicate with each other.

The first scroll back pressure hole 1812 and the first plate back pressure hole 1813 may be formed on a same axial line or on different axial lines. This may be appropriately adjusted depending on components adjacent to the first scroll back pressure hole 1812 and the first plate back pressure hole 1813 or shapes of the first scroll back pressure hole 1812 and the first plate back pressure hole 1813.

For example, when the first back pressure valve 1815 discussed hereinafter is configured as a reed valve and is installed on an upper surface of the back pressure plate 161 (more specifically, the fixed end plate portion) defining a bottom surface of the back pressure chamber 160*a*, the first scroll back pressure hole 1812 and the first plate back pressure hole 1813 may be formed on the same axial line. However, considering a width of the first back pressure valve 1815, the first plate back pressure hole 1813 may be supposed to be located at a center of a bottom surface of the back pressure chamber 160*a*. In this case, the first scroll back pressure hole 1812 and the first plate back pressure hole 1813 may be formed to be located on different axial lines to increase a degree of freedom in a position where the first scroll back pressure hole 1812 is formed.

This is also achieved in a case in which the first back pressure valve 1815 discussed hereinafter is configured as a plate valve and/or a piston valve to be slidably inserted into the first scroll back pressure hole 1812 or the first plate back pressure hole 1813. For example, when the first back pressure valve 1815 discussed hereinafter is configured as a piston valve and is slid into the first scroll back pressure hole 1812, the first scroll back pressure hole 1812 and the first plate back pressure hole 1813 may be formed on the same axial line. However, considering the width of the first back pressure valve 1815, the first plate back pressure hole 1813 may be located at an outside of the back pressure chamber 160*a*. In this case, the first scroll back pressure hole 1812 and the first plate back pressure hole 1813 may be located on different axial lines to increase the degree of freedom in the position at which the first plate back pressure hole 1813 is formed. Hereinafter, an example in which the first back pressure valve 1815 discussed hereinafter is configured as a piston valve will be mainly described.

Referring to FIG. 6, the first scroll back pressure hole 1812 according to this embodiment may include a first valve receiving groove 1812*a* and a first communication hole 1812*b*. The first valve receiving groove 1812*a* is a portion into which the first back pressure valve 1815 is slidably inserted, and the first communication hole 1812*b* is a portion that opens toward the compression chamber V.

The first valve receiving groove 1812*a* may be recessed by a preset or predetermined depth into the rear surface of the non-orbiting end plate portion 151 toward the compression chamber V. For example, a depth of the first valve receiving groove 1812*a* may be slightly larger than a thickness of the first back pressure valve 1815 discussed hereinafter. This may minimize an empty space of the first valve receiving groove 1812*a* excluding the first back pressure valve 1815, thereby reducing a dead volume.

The first valve receiving groove 1812*a* may have substantially a same cross-sectional shape as that of the first back pressure valve 1815 discussed hereinafter, but may have a circular cross-sectional shape which has an outer diameter slightly larger than an outer diameter of the first back pressure valve 1815. Accordingly, the first back pressure valve 1815 discussed hereinafter may open and close the first back pressure hole 1811 while sliding in the axial direction along an inner circumferential surface of the first valve receiving groove 1812*a*.

The first communication hole 1812*b* may extend through between a bottom surface of the first valve receiving groove 1812*a* and one side surface of the non-orbiting end plate portion 151, that is, the upper surface of the non-orbiting end plate portion 151 defining the compression chamber V. Accordingly, the first valve receiving groove 1812*a* may communicate with the corresponding compression chamber V through the first communication hole 1812*b*.

The first communication hole 1812*b* may be formed adjacent to an inner circumferential surface of the non-orbiting wrap 152 or to an outer circumferential surface of the non-orbiting wrap 152. In other words, the first communication hole 1812*b* may communicate with the first compression chamber V1, but in some cases, may communicate with the second compression chamber V2. In this embodiment, as illustrated in FIG. 6, an example in which the first communication hole 1812*b* is formed adjacent to the inner circumferential surface of the non-orbiting wrap 152 is shown. Accordingly, an opening time of the first communication hole 1812*b* may be minimized, so that the refrigerant in the compression chamber V may quickly flow into the back pressure chamber 160*a*.

Referring to FIGS. 6 and 7, the first communication hole 1812*b* may be smaller than the first valve receiving groove 1812*a*. In other words, an inner diameter of the first communication hole 1812*b* may be smaller than an inner diameter of the first valve receiving groove 1812*a*. Accordingly, a first compression opening and closing surface 1812*c* may be formed between the first valve receiving groove 1812*a* and the first communication hole 1812*b*, to restrict the first back pressure valve 1815 configured as the piston valve from moving toward the compression chamber V.

In addition, an inner diameter of the first communication hole 1812*b* may be smaller than a wrap thickness of the orbiting wrap 142 facing it. Accordingly, the first communication hole 1812*b* may independently communicate with the first compression chamber V1 or the second compression chamber V2, thereby suppressing in advance leakage of refrigerant between the compression chambers through the first communication hole 1812*b*.

Referring to FIGS. 5 and 6, the first plate back pressure hole 1813 according to this embodiment may be formed through between a rear surface of the back pressure plate 161 and one side surface of the back pressure chamber 160*a*, that is, a bottom surface of the back pressure plate 161. In other words, one (first) end of the first plate back pressure hole 1813 may communicate with the first valve receiving groove 1812*a* forming a portion of the first scroll back pressure hole 1812, and another (second) end of the first plate back pressure hole 1813 may communicate with the back pressure chamber 160*a*. Accordingly, a part or portion of the refrigerant suctioned into the corresponding compression chamber V moves from the compression chamber V to the back pressure chamber 160*a* through the first scroll back pressure hole 1812 and the first plate back pressure hole 1813 according to a pressure difference between the compression chamber V and the back pressure chamber 160*a*.

Referring to FIG. 7, an inner diameter of the first scroll back pressure hole 1812 may be smaller than that of the first valve receiving groove 1812*a* but larger than that of the first communication hole 1812*b*. In addition, the inner diameter of the first scroll back pressure hole 1812 may be larger than a width of an opening and closing surface (no reference numeral given) of the first back pressure valve 1815 discussed hereinafter. For example, the inner diameter of the first scroll back pressure hole 1812 may be larger than a diameter of a first imaginary circle C1 connecting a circumferential surface of a communication groove 1817 discussed hereinafter. Accordingly, the refrigerant in the compression chamber V may be allowed to move to the back pressure chamber 160*a* through the first communication groove 1817 of the first back pressure valve 1815 discussed hereinafter while refrigerant in the back pressure chamber 160*a* may be restricted from moving to the compression chamber V through a second communication groove 1827 of the second back pressure valve 1825 discussed hereinafter.

The first plate back pressure hole 1813 may have a same inner diameter between both ends thereof along the axial direction, but may be smaller than an inner diameter of the first valve receiving groove 1812*a*. Accordingly, a first back pressure opening and closing surface 1813*c* may be formed between the first valve receiving groove 1812*a* and the first plate back pressure hole 1813, to restrict the first back pressure valve 1815 configured as the piston valve from moving toward the back pressure chamber 160*a*.

In addition, as described above, the first plate back pressure hole 1813 may be formed on a same axis as the first scroll back pressure hole 1812 or may be formed on different axes. This embodiment illustrates an example in which the first plate back pressure hole 1813 is formed on the same axis as the second scroll back pressure hole 1812. Accordingly, the first back pressure opening and closing surface 1813*c* defined between the first valve receiving groove 1812*a* and the first plate back pressure hole 1813 may have a same area along the circumferential direction, so as to stably support the first back pressure valve 1815 while achieving a constant opening area with respect to the first communication groove 1817 in the circumferential direction.

Referring to FIGS. 5 and 6, the first back pressure valve 1815 according to this embodiment may be configured as the piston valve, as described above. For example, the first back pressure valve 1815 may have an axial thickness that is approximately half or close to half a thickness of the non-orbiting end plate portion 151. Accordingly, the first communication hole 1812*b* which is relatively difficult to be machined may be formed small by making a depth of the first valve receiving groove 1812*a* larger than a length of the first communication hole 1812*b*, thereby facilitating machining of the first scroll back pressure hole 1812 and reducing a dead volume in the first valve receiving groove 1812*a*.

The first back pressure valve 1815 may include a first valve body 1816 and a first communication groove 1817. The first valve body 1816 is a portion that closes the first back pressure hole 1811, and the first communication groove 1817 is a portion that communicates with the first back pressure hole 1811.

The first valve body 1816 may have a cross-sectional shape substantially equal to that of the first valve receiving groove 1812*a*, for example, a solid cylindrical cross-sectional shape. The first valve body 1816 may be formed such that an outer diameter thereof is slightly smaller than the inner diameter of the first valve receiving groove 1812*a*. Accordingly, the first valve body 1816 may move substantially in the axial direction along the inner circumferential surface of the first valve receiving groove 1812*a*.

Referring to FIG. 7, the outer diameter of the first valve body 1816 may be larger than or equal to the inner diameter of the first plate back pressure hole 1813, for example, larger than the inner diameter of the first plate back pressure hole 1813. Accordingly, when the first valve body 1816 is brought into close contact with the first back pressure opening and closing surface 1813*c*, that is, the rear surface of the back pressure plate 161, the first plate back pressure hole 1813 may be closed.

The first communication groove 1817 may be recessed by a preset or predetermined depth into an outer circumferential surface of the first valve body 1816. For example, the first communication groove 1817 may be recessed into the outer circumferential surface of the first valve body 1816, in a manner of being recessed by a same depth between both axial ends. This may facilitate machining of the first communication groove 1817 and allow a flow rate of refrigerant passing through the first communication groove 1817 to be maintained constant.

The depth of the first communication groove 1817 may be defined such that a diameter of the first imaginary circle C1 connecting the circumferential surface of the first communication groove 1817 is larger than or equal to the inner diameter of the first communication hole 1812*b* or smaller than or equal to the inner diameter of the first plate back pressure hole 1813. Accordingly, the first valve body 1816 may close the first communication hole 1812*b* on the first compression opening and closing surface 1812*c*, while opening the first plate back pressure hole 1813 on the first back pressure opening and closing surface 1813*c*.

Also, the first back pressure valve 1815 according to this embodiment may be made of a metallic material. However, the first back pressure valve 1815 may alternatively be made of a non-metallic material, such as engineered plastic in consideration of weight.

Although not shown in the drawings, the first back pressure valve 1815 may be configured as a plate valve as well as a piston valve. Even when the first back pressure valve 1815 is configured as a plate valve, the basic configuration or operating effects of the first back pressure valve 1815 as well as the previously described first back pressure hole 1811 may be substantially the same.

On the other hand, as described above, the second back pressure unit 182 may be located at the discharge side compared to the first back pressure unit 181 and may be open and closed in an opposite way to the first back pressure unit 181, but has a similar basic configuration to that of the first back pressure unit 181. Therefore, the second back pressure unit 182 will be described, but duplicate portions thereof with the first back pressure unit 181 will be understood by the description of the first back pressure unit 181.

Referring to FIGS. 5 and 6, the second back pressure unit 182 according to this embodiment may include a second back pressure hole 1821 and a second back pressure valve 1825. The second back pressure hole 1821 may include a second scroll back pressure hole 1822 formed through the non-orbiting end plate portion 151 in the axial direction, and a second plate back pressure hole 1823 formed through the back pressure plate 161 and communicating with the second scroll back pressure hole 1822. Accordingly, the second scroll back pressure hole 1822 and the second plate back pressure hole 1823 may communicate with each other.

The second scroll back pressure hole 1822 and the second plate back pressure hole 1823 may be formed on a same axis as the first scroll back pressure hole 1812 and the first plate back pressure hole 1813, or on different axes. This may be appropriately adjusted depending on components adjacent to the second scroll back pressure hole 1822 and the second plate back pressure hole 1823 or shapes of the second scroll back pressure hole 1822 and the second plate back pressure hole 1823.

The second scroll back pressure hole 1822 according to this embodiment may include a second valve receiving groove 1822*a* and a second communication hole 1822*b*. The second valve receiving groove 1822*a* is a portion into which the second back pressure valve 1825 is slidably inserted, and the second communication hole 1822*b* is a portion that opens toward the compression chamber V.

The second valve receiving groove 1822*a*, like the first valve receiving groove 1812*a*, may be recessed by a preset or predetermined depth into the rear surface of the non-orbiting end plate portion 151 toward the compression chamber V. For example, a depth of the second valve receiving groove 1822*a* may be slightly larger than a thickness of the second back pressure valve 1825 discussed hereinafter. This may minimize an empty space of the second valve receiving groove 1822*a* excluding the second back pressure valve 1825, thereby reducing a dead volume.

The second valve receiving groove 1822*a* may have substantially a same cross-sectional shape as that of the second back pressure valve 1825 discussed hereinafter, but may have a circular cross-sectional shape which has an outer diameter slightly larger than an outer diameter of the second back pressure valve 1825. Accordingly, the second back pressure valve 1825 discussed hereinafter may open and close the second back pressure hole 1821 while sliding in the axial direction along the inner circumferential surface of the second valve receiving groove 1822*a*.

The second communication hole 1822*b* may be formed through between a bottom surface of the second valve receiving groove 1822*a* and one side surface of the non-orbiting end plate portion 151, that is, the upper surface of the non-orbiting end plate portion 151 defining the compression chamber V. Accordingly, the second valve receiving groove 1822*a* may communicate with the corresponding compression chamber V through the second communication hole 1822*b*, that is, with a compression chamber having a higher pressure than a pressure of a compression chamber V, with which the first communication hole 1812*b* communicates.

The second communication hole 1822*b* may be formed adjacent to an inner circumferential surface of the non-orbiting wrap 152 or to an outer circumferential surface of the non-orbiting wrap 152. In other words, the second communication hole 1822*b* may communicate with the first compression chamber V1, but in some cases, may communicate with the second compression chamber V2. In this embodiment, as illustrated in FIG. 5, an example in which the second communication hole 1822*b* is formed adjacent to the inner circumferential surface of the non-orbiting wrap 152 is shown. Accordingly, an opening time of the second communication hole 1822*b* may be minimized, so that the refrigerant in the compression chamber 160*a* may quickly flow into the back pressure chamber V.

Referring to FIGS. 6 and 8, the second communication hole 1822*b* may be smaller than the second valve receiving groove 1822*a*. In other words, an inner diameter of the second communication hole 1822*b* may be smaller than an inner diameter of the second valve receiving groove 1822*a*. Accordingly, a second compression opening and closing surface 1822*c* may be formed between the second valve receiving groove 1822*a* and the second communication hole 1822*b*, to restrict the second back pressure valve 1825 configured as the piston valve from moving toward the compression chamber V.

In addition, the inner diameter of the second communication hole 1822*b* may be smaller than a wrap thickness of the orbiting wrap 142 facing it. Accordingly, the second communication hole 1822*b* may independently communicate with the second compression chamber V1 or the second compression chamber V2, thereby suppressing leakage of refrigerant between the compression chambers through the second communication hole 1822*b*.

In this case, the second communication hole 1822*b* may be formed on a same axis as the second valve receiving groove 1822*a*. However, depending on a shape of the second back pressure valve 1825, the second communication hole 1822*b* may be formed eccentrically with respect to the second valve receiving groove 1822*a*. In this embodiment, an example in which the second communication groove 1827 discussed hereinafter is formed in the outer circumferential surface of the second back pressure valve 1825 discussed hereinafter while the second communication hole 1822*b* is formed on a different axis from the second valve receiving groove 1822*a*, namely, to be radially eccentric from the center of the second valve receiving groove 1822*a*.

The second plate back pressure hole 1823 according to this embodiment may extend through between the rear surface of the back pressure plate 161 and one side surface of the back pressure chamber 160*a*, that is, the bottom surface of the back pressure plate 161. In other words, one (first) end of the second plate back pressure hole 1823 may communicate with the second valve receiving groove 1822*a* forming a portion of the second scroll back pressure hole 1822, and another (second) end of the second plate back pressure hole 1823 may communicate with the back pressure chamber 160*a*. Accordingly, a part or portion of the refrigerant suctioned into the corresponding compression chamber V may move from the compression chamber to the back pressure chamber 160*a* through the second scroll back pressure hole 1822 and the second plate back pressure hole 1823 according to a pressure difference between the compression chamber V and the back pressure chamber 160*a*.

Referring to FIGS. 6 and 8, an inner diameter of the second scroll back pressure hole 1822 may be smaller than that of the second valve receiving groove 1822*a* but larger than that of the second communication hole 1822*b*. However, the inner diameter of the second scroll back pressure hole 1822 may be smaller than a width of an opening and closing surface (no reference numeral given) of the second back pressure valve 1812 discussed hereinafter, unlike the previously described first scroll back pressure hole 1812. For example, the inner diameter of the second scroll back pressure hole 1822 may be smaller than a diameter of a second imaginary circle C2 connecting a circumferential surface of the second communication groove 1827 discussed hereinafter. Accordingly, the refrigerant in the back pressure chamber 160*a* may be allowed to move to the compression chamber 160*a* through the second communication groove 1827 of the second back pressure valve 1825 discussed hereinafter while refrigerant in the compression chamber V may be restricted from moving to the back pressure chamber 160*a* through the second communication groove 1827 of the second back pressure valve 1825 discussed hereinafter.

The second plate back pressure hole 1823 may have an inner diameter which is uniform between both ends thereof along the axial direction but smaller than the inner diameter of the second valve receiving groove 1822*a*. Accordingly, a second back pressure opening and closing surface 1823*c* may be formed between the second valve receiving groove 1822*a* and the second plate back pressure hole 1823, to restrict the second back pressure valve 1825 configured as the piston valve from moving toward the back pressure chamber 160*a*.

In addition, as described above, the second plate back pressure hole 1823 may be formed on a same axis as the second scroll back pressure hole 1822 or they may be formed on different axes. This embodiment illustrates an example in which the second plate back pressure hole 1823 is formed on the same axis as the second scroll back pressure hole 1822. Accordingly, the second back pressure opening and closing surface 1823*c* defined between the second valve receiving groove 1822*a* and the second plate back pressure hole 1823 may be formed to have a same area along the circumferential direction, so as to stably support the second back pressure valve 1825 while achieving a constant opening area of the second back pressure valve 1825 discussed hereinafter with respect to the second communication groove 1827 along the circumferential direction.

Referring to FIGS. 5 and 6, the second back pressure valve 1825 according to this embodiment may be configured as the piston valve, as described above. For example, the second back pressure valve 1825 may be formed to have an axial thickness that is approximately half or close to half the thickness of the non-orbiting end plate portion 151. Accordingly, the second communication hole 1822*b* which is relatively difficult to be machined may be formed small by making a depth of the second valve receiving groove 1822*a* larger than a length of the second communication hole 1822*b*, thereby facilitating machining of the second scroll back pressure hole 1822 and reducing a dead volume in the second valve receiving groove 1822*a*.

The second back pressure valve 1825 may include a second valve body 1826 and a second communication groove 1827. The second valve body 1826 is a portion that closes the second back pressure hole 1821, and the second communication groove 1827 is a portion that communicates with the second back pressure hole 1821.

The second valve body 1826 may have a cross-sectional shape substantially equal to that of the second valve receiving groove 1822*a*, for example, a solid cylindrical cross-sectional shape. The second valve body 1826 may be formed such that an outer diameter thereof is slightly smaller than the inner diameter of the second valve receiving groove

1822*a*. Accordingly, the second valve body 1826 may move substantially in the axial direction along the inner circumferential surface of the second valve receiving groove 1822*a*.

Also, the outer diameter of the second valve body 1826 may be larger than or equal to the inner diameter of the second plate back pressure hole 1823, for example, larger than the inner diameter of the second plate back pressure hole 1823. Accordingly, when the second valve body 1826 is brought into close contact with the second back pressure opening and closing surface 1823*c*, that is, the rear surface of the back pressure plate 161, the second plate back pressure hole 1823 may be closed.

Referring to FIGS. 6 and 8, the second communication groove 1827 may be recessed by a preset or predetermined depth into an outer circumferential surface of the second valve body 1826. For example, the second communication groove 1827 may be recessed into the outer circumferential surface of the second valve body 1826, in a manner of being recessed by a same depth between both axial ends. This may facilitate machining of the first communication groove 1817 and allow a flow rate of refrigerant passing through the first communication groove 1817 to be maintained constantly.

The second communication groove 1827 has a depth which is deep enough for the second communication groove 1827 to axially communicate with the second communication hole 1822*b* which is eccentric from a center of the second valve receiving groove 1822*a*. Also, the depth of the second communication groove 1827 may be larger than or equal to the inner diameter of the second plate back pressure hole 1823. Accordingly, the second valve body 1826 may open the second communication hole 1822*b* on the second compression opening and closing surface 1822*c* while closing the second plate back pressure hole 1823 on the second back pressure opening and closing surface 1822*c*. In other words, the second valve body 1826 may operate in an opposite way to the first valve body 1816.

In addition, although only one second communication groove 1827 may be formed in the outer circumferential surface of the second valve body 1826, the second communication groove 1827 may be provided as a plurality disposed at predetermined distances along the circumferential direction. This embodiment shows an example in which the plurality of second communication grooves 1827 is formed at equal distances along the circumferential direction.

Like the first back pressure valve 1815, the second back pressure valve 1825 according to this embodiment may be formed of a metallic material. However, the second back pressure valve 1825 may alternatively be made of a non-metallic material, such as engineered plastic, in consideration of weight.

Although not shown in the drawings, the second back pressure valve 1825, like the first back pressure valve 1815, may be configured as the plate valve as well as the piston valve. Even when the second back pressure valve 1825 is configured as a plate valve, the basic configuration or operating effects of the second back pressure valve 1825 as well as the previously described second back pressure hole 1821 may be substantially the same.

Figure 9:
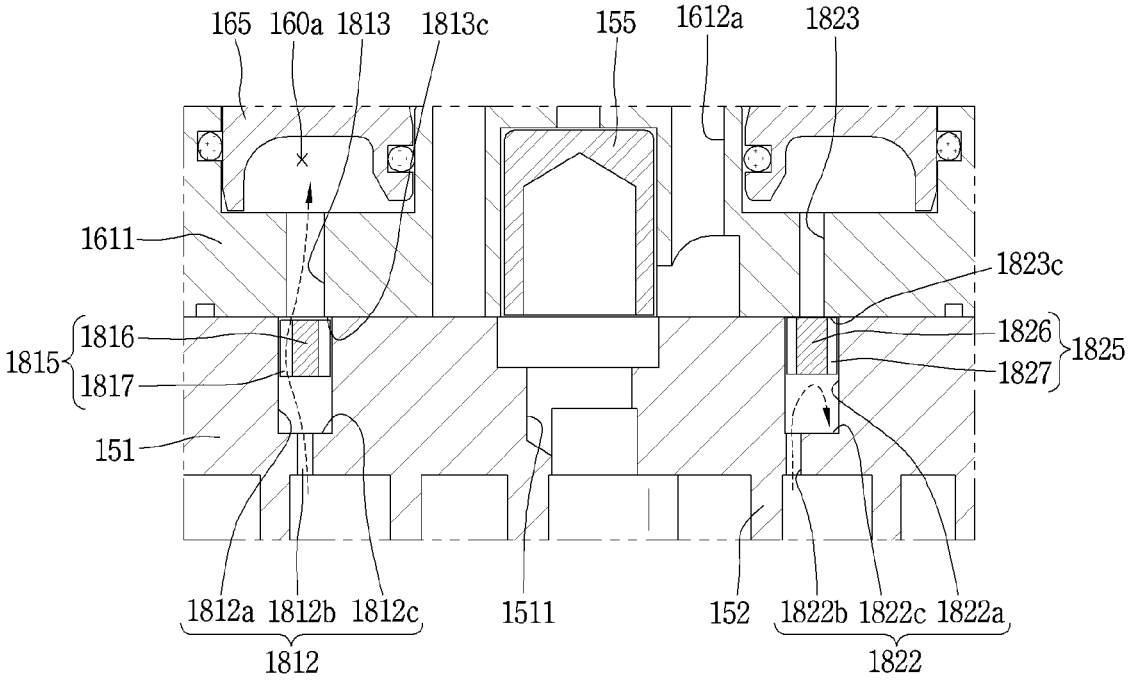
FIG. 9 is a cross-sectional view illustrating a back pressure forming operation in a scroll compressor in accordance with an embodiment.
Figure 10:
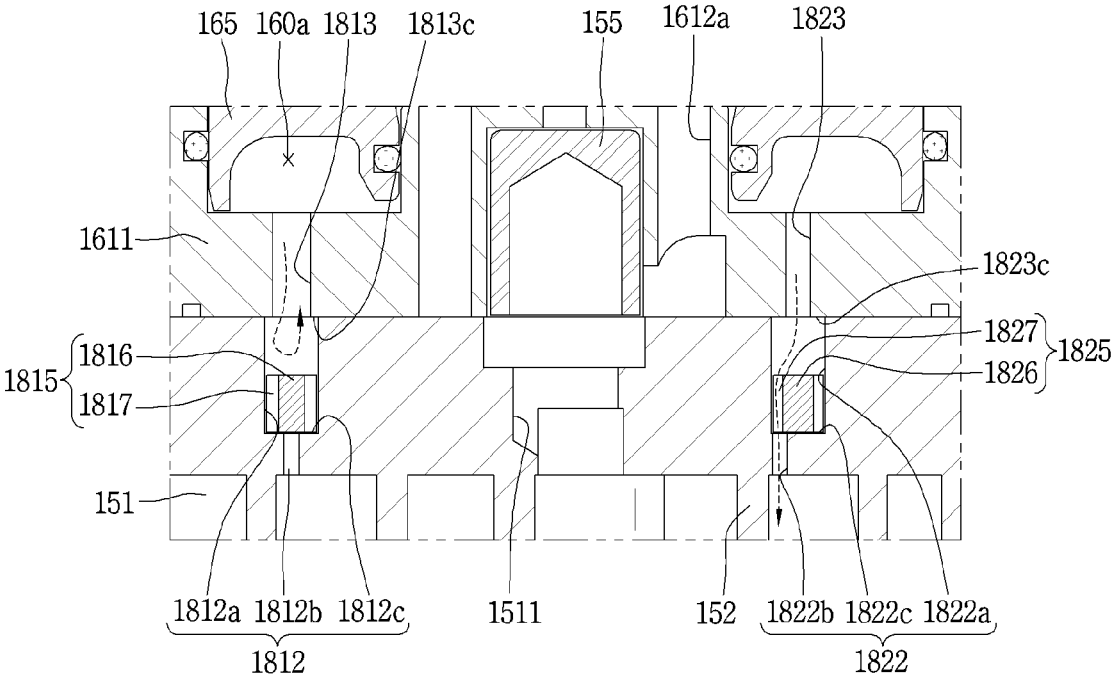
FIG. 10 is a cross-sectional view illustrating a back pressure relieving operation in a scroll compressor in accordance with an embodiment.

The first back pressure unit and the second back pressure unit according to this embodiment operate in opposite ways to each other. FIG. 9 is a cross-sectional view illustrating a back pressure forming operation in a scroll compressor in accordance with an embodiment and FIG. 10 is a cross-sectional view illustrating a back pressure relieving operation in a scroll compressor in accordance with an embodiment.

As illustrated in FIG. 9, when the pressure in the compression chamber V is higher than the pressure in the back pressure chamber 160*a*, a part or portion of the refrigerant suctioned into the compression chamber V or a part or portion of the refrigerant compressed in the compression chamber V is introduced into the first communication hole 1812*b*, so as to press the first valve body 1816 toward the back pressure chamber 160*a*.

Then, the first valve body 1816 is pushed by the pressure of the refrigerant introduced through the first communication hole 1812*b* and rises from the first valve receiving groove 1812*a* toward the back pressure chamber 160*a*. Then, the first communication hole 1812*b* and the first plate back pressure hole 1813 communicate with each other through the first communication groove 1817 disposed in the outer circumferential surface of the first back pressure valve 1815.

The refrigerant in the compression chamber moves to the back pressure chamber 160*a* through the first communication hole 1812*b*, the first valve receiving groove 1812*a*, and the first plate back pressure hole 1813. Then, the back pressure which forms (low) first intermediate pressure is formed in the back pressure chamber 160*a* so as to push the non-orbiting scroll 150 toward the orbiting scroll 140. Accordingly, the orbiting scroll 140 and the non-orbiting scroll 150 may be tightly sealed from each other, which may suppress leakage between the compression chambers V. Therefore, the compressor operates normally.

On the other hand, as illustrated in FIG. 10, when the pressure in the compression chamber V is lower than the pressure in the back pressure chamber 160*a*, the back pressure chamber 160*a* communicates with the first valve receiving groove 1812*a* through the first plate back pressure hole 1813, to push the first valve body 1816 toward the compression chamber V. Then, the first valve body 1816 is pushed by the pressure of the refrigerant introduced through the first plate back pressure hole 1813 and moved down from the first valve receiving groove 1812*a* toward the compression chamber V. Accordingly, the first communication hole 1812*b* and the first plate back pressure hole 1813 are blocked from each other by the first valve body 1816.

At this time, the second back pressure valve 1825, like the first back pressure valve 1815, is pushed by the pressure of the back pressure chamber 160*a* and moved down toward the compression chamber V. However, in this case, the second communication hole 1822*b* communicates with the second plate back pressure hole 1823 through the second communication groove 1827 disposed in the outer circumferential surface of the second back pressure valve 1825. The refrigerant (and oil) of the back pressure chamber 160*a* flows out of the compression chamber V through the second plate back pressure hole 1823 and the second communication hole 1822*b*, and thereby the pressure of the back pressure chamber 160*a* is lowered. Accordingly, even if (high) second intermediate pressure is temporarily formed in the back pressure chamber 160*a*, it is quickly relieved by the second back pressure unit 182, thereby suppressing the orbiting scroll 140 and the non-orbiting scroll 150 from being excessively brought into contact with each other.

In this way, as the first back pressure unit 181 and the second back pressure unit 182 communicate with compression chambers each having a different pressure in the non-orbiting back pressure type scroll compressor, the pressure in the back pressure chamber 160*a* may actively change in response to the pressure changes in the compression chambers V. This may result in lowering pressure pulsation in the back pressure chamber 160*a*.

In addition, in the non-orbiting back pressure type scroll compressor, the first back pressure unit 181 and the second back pressure unit 182 may suppress excessive increase in pressure in the back pressure chamber 160*a*, thereby reducing a mechanical friction loss between the orbiting scroll 140 and the non-orbiting scroll 150. Also, the second back pressure unit 182 may suppress overcompression, which is caused because refrigerant in the back pressure chamber 160*a* leaks into the discharge port 1511 or the compression chamber V adjacent to the discharge port 1511 to flow backward from the back pressure chamber 160*a* to the compression chamber V.

In addition, in the non-orbiting back pressure type scroll compressor, a dead volume generated due to the back pressure chamber 160*a* may be reduced by installing the back pressure valve 1815 in the back pressure hole 1811, 1821, through which the compression chamber and the back pressure chamber 160*a* are connected to each other, to open and close the back pressure hole 1811, 1821. As illustrated in this embodiment, as the back pressure valve 1815, 1825 is disposed in the non-orbiting scroll 150 forming the compression chamber, the dead volume may be further reduced.

In the non-orbiting back pressure type scroll compressor, as the non-orbiting scroll 150 is pressed toward the orbiting scroll 140 by the pressure in the back pressure chamber 160*a*, it is advantageous in terms of efficiency of the compressor to maintain a pressure difference between the back pressure chamber 160*a* and the compression chamber V as constant as possible. Therefore, as in this embodiment, the pressure in the back pressure chamber 160*a* may vary in response to the pressure in the compression chamber V, thereby improving compression efficiency in the low load operating conditions (or low pressure ratio operation) in which the suction pressure in the compression chamber is lowered.

Hereinafter, another embodiment related to positions at which the first back pressure unit and the second back pressure unit are formed will be described.

That is, in the previous embodiment, the first back pressure valve constituting the first back pressure unit and the second back pressure valve constituting the second back pressure unit are disposed in the non-orbiting scroll, but in some cases, the first back pressure valve and the second back pressure valve may alternatively be disposed in the back pressure chamber assembly.

Figure 11:
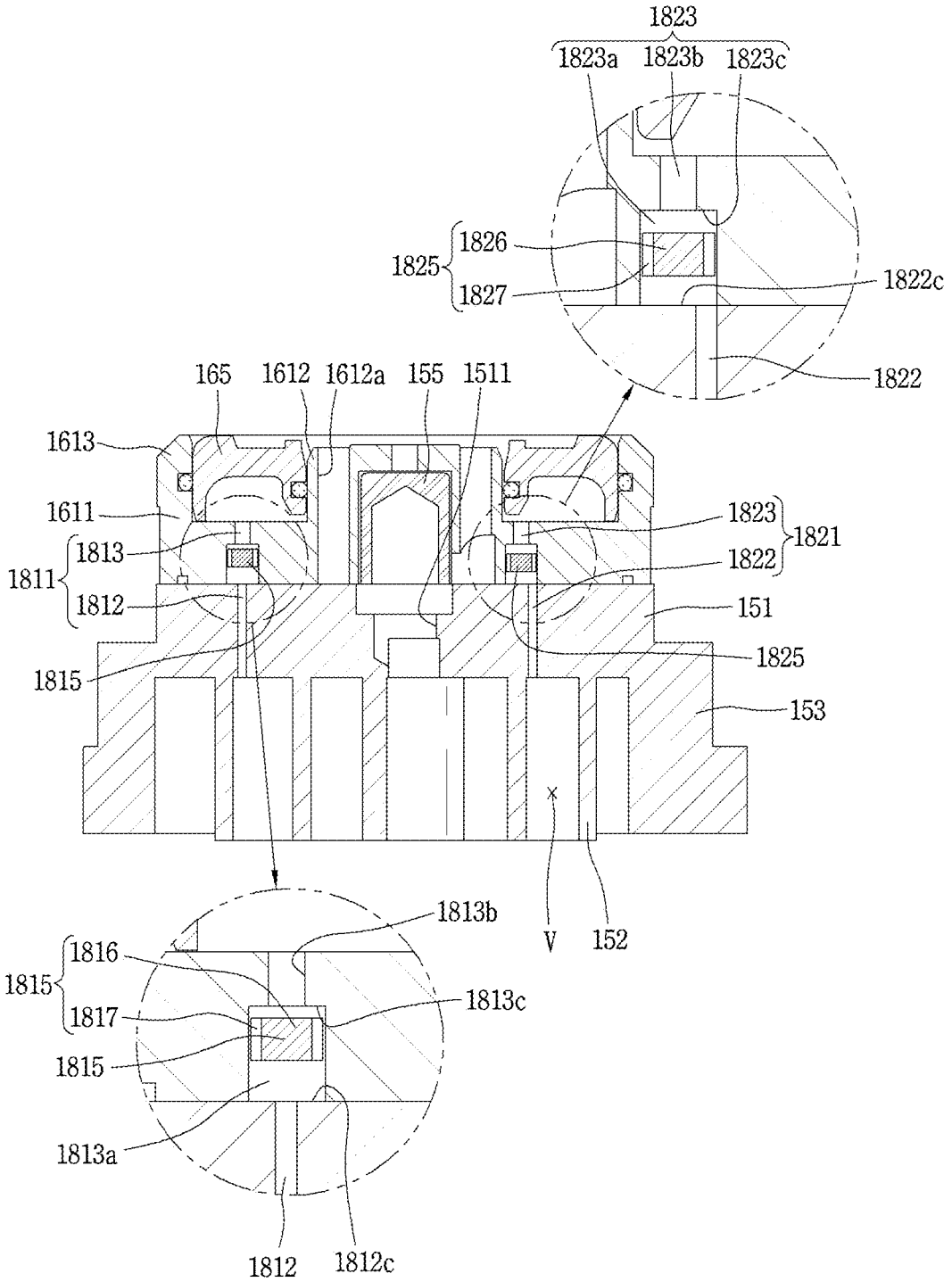
FIG. 11 is a cross-sectional view for explaining positions of a first back pressure valve and a second back pressure valve in accordance with another embodiment.

FIG. 11 is a cross-sectional view explaining positions of a first back pressure valve and a second back pressure valve in accordance with another embodiment.

Referring back to FIGS. 1 to 10, the basic structure of the scroll compressor according to this embodiment is similar to that in the previous embodiment. For example, back pressure chamber assembly 160 forming back pressure chamber 160*a* is disposed on the upper surface of non-orbiting scroll 150, so that the non-orbiting scroll 150 is pushed toward orbiting scroll 140 by the pressure of the back pressure chamber 160*a*. Accordingly, the non-orbiting scroll 150 may be brought into close contact with the orbiting scroll 140 in the axial direction, so that leakage between compression chambers in the axial direction may be suppressed.

In this embodiment, as in the previous embodiment, first back pressure unit 181 allowing the refrigerant movement from the compression chamber V and the back pressure chamber 160*a* and second back pressure unit 182 allowing the refrigerant movement from the back pressure chamber 160*a* to the compression chamber V may be disposed between the compression chamber V and the back pressure chamber 160*a*. In this configuration, the first back pressure unit 181 and the second back pressure unit 182 may be disposed at a preset or predetermined distance therebetween along the formation direction of the compression chamber V. For example, the first back pressure unit 181 may be disposed more adjacent to a suction side than the second back pressure unit 182, while the second back pressure unit 182 may be disposed more adjacent to a discharge side than the first back pressure unit 181. The detailed positions are the same/like as those in the previous embodiment, and thus, detailed description thereof will be replaced with the foregoing description.

However, in the case of this embodiment, the first back pressure unit 181 and the second back pressure unit 182 may be disposed on the back pressure plate 161 constituting a portion of the back pressure chamber assembly 160. Accordingly, the structure of the non-orbiting scroll 150, which is relatively difficult to be machined, may be simplified compared to the previous embodiment, which may result in easily manufacturing the scroll compressor including the non-orbiting scroll 150.

The basic structure of the first back pressure unit 181 and the second back pressure unit 182 according to this embodiment and effects thereof are similar to those of the previous embodiment. In other words, the first back pressure unit 181 may include first back pressure hole 1811 and first back pressure valve 1815 to allow movement of the refrigerant from the compression chamber to the back pressure chamber 160*a* but block movement of the refrigerant in the reverse direction. The second back pressure unit 182 may include second back pressure hole 1821 and second back pressure valve 1825 to allow movement of the refrigerant from the back pressure chamber 160*a* to the compression chamber V but block movement of the refrigerant in the reverse direction.

For example, the first back pressure valve 1815 and the second back pressure valve 1825 according to this embodiment may be configured as piston valves or plate valves as in the previous embodiment, or may be configured as typical reed valves. This embodiment will be described focusing on an example employing a piston valve similar to the previous embodiment.

The first back pressure unit 181 according to this embodiment may include first back pressure hole 1811 and first back pressure valve 1815. The basic configuration and effects of the first back pressure unit 181 are similar to those of the first back pressure unit 181 of the embodiment described with reference to FIGS. 6 and 7.

Referring to FIG. 11, the first back pressure hole 1811 may include first scroll back pressure hole 1812 disposed in the non-orbiting end plate portion 151, and first plate back pressure hole 1813 disposed in the back pressure plate 161. The first scroll back pressure hole 1812 and the first plate back pressure hole 1813 may be formed on a same axial line or on different axial lines. This embodiment illustrates an example in which the first scroll back pressure hole 1812 and the first plate back pressure hole 1813 are formed on the same axis.

The first scroll back pressure hole 1812 may be formed through between the upper surface of the non-orbiting end plate portion 151 forming the compression chamber V and the non-orbiting end plate portion 151 facing the back pressure plate 161. The first scroll back pressure hole 1812 may have an inner diameter that is constant between both ends thereof.

The first plate back pressure hole 1813 may include first valve receiving groove 1813*a* and first communication hole

1813*b*. The first valve receiving groove 1813*a* is a portion into which the first back pressure valve 1815 is slidably inserted in the axial direction. One end of the first valve receiving groove 1813*a* may communicate with the first scroll back pressure hole 1812, and an inner diameter of the first valve receiving groove 1813*a* may be greater than an inner diameter of the first scroll back pressure hole 1812. Accordingly, a first compression opening and closing surface 1812*c* may be formed between the first plate back pressure hole 1813 and the first scroll back pressure hole 1812 to restrict movement of the first back pressure valve 1815 toward the compression chamber.

The first communication hole 1813*b* may be formed at an end portion, opposite to the first scroll back pressure hole 1812, of both ends of the first valve receiving groove 1813*a*, such that the first valve receiving groove 1813*a* and the back pressure chamber 160*a* communicate with each other therethrough. An inner diameter of the first communication hole 1813*b* may be smaller than an inner diameter of the valve receiving groove 1813*a*. Accordingly, a first back pressure opening and closing surface 1813*c* may be defined between the first communication hole 1813*b* and the first valve receiving groove 1813*a*, to restrict movement of the first back pressure valve 1815 toward the back pressure chamber 160*a*.

The first back pressure valve 1815 according to this embodiment may include first valve body 1816 and first communication groove 1817. The basic configuration of the first back pressure valve 1815 and its operating effects may be substantially the same as those of the first back pressure valve 1815 of FIGS. 3 to 7. Therefore, description of the first back pressure valve 1815 according to this embodiment will be replaced with the description of the first back pressure valve 1815 of FIGS. 3 to 7.

The second back pressure unit 182 according to this embodiment may include a second back pressure hole 1821 and a second back pressure valve 1825. Similar to the first back pressure unit 181, the basic configuration of the second back pressure unit 182 and its operating effects are similar to those of the second back pressure unit 182 of the embodiment described with reference to FIGS. 6 and 8.

Referring to FIG. 11, the second back pressure hole 1821 may include second scroll back pressure hole 1822 disposed in the non-orbiting end plate portion 151, and second plate back pressure hole 1823 disposed in the back pressure plate 161. The second scroll back pressure hole 1822 and the second plate back pressure hole 1823 may be formed on a same axial line or on different axial lines. This embodiment illustrates an example in which the second scroll back pressure hole 1822 and the second plate back pressure hole 1823 are formed on different axes.

The second scroll back pressure hole 1822 may be formed through between the upper surface of the non-orbiting end plate portion 151 forming the compression chamber V and the non-orbiting end plate portion 151 facing the back pressure plate 161. The second scroll back pressure hole 1822 may have an inner diameter that is constant between both ends thereof.

The second plate back pressure hole 1823 may include second valve receiving groove 1823*a* and second communication hole 1823*b*. The second valve receiving groove 1823*a* is a portion into which the second back pressure valve 1825 is slidably inserted in the axial direction. One end of the second valve receiving groove 1823*a* may communicate with the second scroll back pressure hole 1822, and an inner diameter of the second valve receiving groove 1813*a* may be greater than the inner diameter of the second scroll back pressure hole 1822. Accordingly, a second compression opening and closing surface 1822*c* may be formed between the second plate back pressure hole 1823 and the second scroll back pressure hole 1822 to restrict movement of the second back pressure valve 1825 toward the compression chamber.

The second communication hole 1823*b* is formed at an end portion, opposite to the second scroll back pressure hole 1822, of both ends of the second valve receiving groove 1823*a*, such that the second valve receiving groove 1823*a* and the back pressure chamber 160*a* communicate with each other therethrough. An inner diameter of the second communication hole 1823*b* may be smaller than an inner diameter of the second valve receiving groove 1823*a*. Accordingly, a second back pressure opening and closing surface 1823*c* may be defined between the second communication hole 1823*b* and the second valve receiving groove 1823*a*, to restrict movement of the second back pressure valve 1825 toward the back pressure chamber 160*a*.

The second back pressure valve 1825 according to this embodiment may include second valve body 1826 and second communication groove 1827. The basic configuration of the second back pressure valve 1825 and its operating effects may be substantially the same as those of the second back pressure valve 1825 of FIGS. 3 to 6 and FIG. 8. Therefore, description of the second back pressure valve 1825 according to this embodiment will be replaced with the description of the second back pressure valve 1825 of FIGS. 3 to 6 and FIG. 8.

Although not shown in the drawings, the first back pressure unit 181 and the second back pressure unit 182 may be disposed in different members. For example, the first back pressure unit 181 may be disposed in the non-orbiting end plate portion 151 and the second back pressure unit 182 may be disposed in the back pressure plate 161, respectively. Conversely, the first back pressure unit 181 may be disposed in the back pressure plate 161 and the second back pressure unit 182 may be disposed in the non-orbiting end plate portion 151, respectively.

In the former, the first back pressure unit 181 may be formed in the non-orbiting end plate portion 151 to suppress refrigerant of relatively high intermediate pressure from flowing backward from the back pressure chamber 160*a* to the compression chamber. Accordingly, the first back pressure hole (more specifically, the first scroll back pressure hole) 1811 may be shortened in length, thereby reducing a dead volume. In the latter, as the second back pressure unit 182 is formed in the non-orbiting end plate portion 151, the second back pressure unit 182 may be formed as close to the discharge port 1511 as possible. Accordingly, even if refrigerant of a relatively high intermediate pressure flows into the compression chamber V, the refrigerant may be quickly discharged through the discharge port 1511, so it may be advantageous to maintain stability of the compression chamber V.

Although not shown in the drawings, the first back pressure valve 1815 and the second back pressure valve 1825 may each be configured as a check valve, such as a ball valve. In this case, shapes of the first back pressure hole 1811 and the second back pressure hole 1821 may be further simplified.

In addition, in the previous embodiments, the structure in which the back pressure chamber assembly 160 including the back pressure plate 161 and the floating plate 165 is separately fastened to the rear surface of the non-orbiting scroll 150 has been described, but in some cases, embodiments may be applied equally to a case in which the back pressure plate 161 is excluded and a first annular wall portion 1612 and a second annular wall portion 1613 extend as a single body from the rear surface of the non-orbiting scroll 150. Even in this embodiment, the basic configurations of the back pressure valves 1815 and 1825 or the operating effects thereof may be substantially the same as those of the previous embodiments.

Embodiments disclosed herein provide a scroll compressor that is capable of lowering pressure pulsation in a back pressure chamber in a non-orbiting back pressure type scroll compressor.

Embodiments disclosed herein also provide a scroll compressor that is capable of suppressing overcompression while reducing mechanical friction loss between an orbiting scroll and a non-orbiting scroll that form compression chambers in a non-orbiting back pressure type scroll compressor.

Embodiments disclosed herein further provide a scroll compressor that is capable of reducing a dead volume between a compression chamber and a back pressure chamber in a non-orbiting back pressure type scroll compressor.

Embodiments disclosed herein furthermore provide a scroll compressor that is capable of increasing compression efficiency when a non-orbiting back pressure type scroll compressor is operated under low load operating conditions (or performs a low pressure ratio operation).

Embodiments disclosed herein provide a scroll compressor that may include a casing, an orbiting scroll, a non-orbiting scroll, a back pressure chamber assembly, a first back pressure unit, and a second back pressure unit may be provided. The casing may have a low-pressure part or portion and a high-pressure part or portion. The orbiting scroll may be coupled to a rotary shaft in the low-pressure part of the casing to perform an orbiting motion. The non-orbiting scroll may be engaged with the orbiting scroll to form compression chambers, and may be movable relative to the orbiting scroll in an axial direction. The back pressure chamber assembly may be disposed on a rear surface of the non-orbiting scroll to form a back pressure chamber. The first back pressure unit may be disposed between the compression chamber and the back pressure chamber, and allow movement of refrigerant from the compression chamber to the back pressure chamber while blocking reverse movement of the refrigerant. The second back pressure unit may be disposed between the back pressure chamber and the compressor chamber with being spaced apart from the back pressure chamber, to allow movement of refrigerant from the back pressure chamber to the compression chamber while blocking reverse movement of the refrigerant. This may reduce pressure pulsation in the back pressure chamber. Also, leakage between compression chambers may be suppressed and simultaneously friction loss may be reduced by appropriately adjusting pressure in the back pressure chamber. This is especially advantageous for enhancing compression efficiency under low load operating conditions (or in a low pressure ratio operation)

For example, the first back pressure unit and the second back pressure unit may communicate with compression chambers having different pressures. With this structure, a passage allowing movement of the refrigerant from the compression chamber to the back pressure chamber may be located as close to a suction side as possible, while a passage allowing movement of the refrigerant from the back pressure chamber to the compression chamber may be located as close to a discharge port as possible.

The first back pressure unit may communicate with a compression chamber having a relatively lower pressure than a pressure of a compression chamber communicating with the second back pressure unit. With this structure, an excessive increase in pressure of refrigerant moving from the compression chamber to the back pressure chamber may be suppressed, while refrigerant moving from the back pressure chamber to the compression chamber may quickly move toward a discharge port.

The first back pressure unit may be disposed at a position after the compression chamber completes a suction stroke. With this structure, the refrigerant moving from the compression chamber to the back pressure chamber may form intermediate pressure, so that the back pressure may be quickly formed.

The second back pressure unit may be disposed at a position within a range in which the compression chamber executes a discharge stroke. With this structure, the refrigerant moving from the back pressure chamber to the compression chamber may be quickly discharged through the discharge port, so that overcompression in the compression chamber may be effectively suppressed.

The first back pressure unit may include a first back pressure hole that communicates between the compression chamber and the back pressure chamber, and a first back pressure valve that opens and closes the first back pressure hole according to a pressure difference between the compression chamber and the back pressure chamber. The second back pressure unit may include a second back pressure hole that communicates between the back pressure chamber and the compression chamber, and a second back pressure valve that opens and closes the second back pressure hole according to a pressure difference between the compression chamber and the back pressure chamber. The first back pressure hole and the second back pressure hole may be spaced apart by a preset or predetermined rotational angle in a direction that the compression chamber is formed. Accordingly, the pressure of the back pressure chamber may be appropriately adjusted according to an operating state of the compressor, so as to secure back pressure for suppressing leakage between compression chambers and simultaneously suppress an excessive increase in back pressure, thereby reducing friction loss that may occur between both scrolls.

The non-orbiting scroll may include a non-orbiting wrap forming the compression chamber, and at least one of the first back pressure hole or the second back pressure hole may be formed between outer and inner surfaces of the non-orbiting wrap to be eccentric to one of the outer and inner surfaces. With this structure, an opening time of the first back pressure hole and/or the second back pressure hole may be minimized so that refrigerant may move quickly between the compression chamber and the back pressure chamber.

The first back pressure hole may be formed within a range of a suction start angle to 250°, and the second back pressure hole may be formed within a range of 255° to a discharge completion angle. With this structure, back pressure may be quickly formed in the back pressure chamber, and the refrigerant moving from the back pressure chamber to the compression chamber may be quickly discharged through the discharge port.

The first back pressure valve may be slidably inserted into the first back pressure hole to open and close the first back pressure hole. The second back pressure valve may be slidably inserted into the second back pressure hole to open and close the second back pressure hole. The first back pressure valve and the second back pressure valve may be symmetrical to each other. This may facilitate the first back pressure valve and the second back pressure valve to be manufactured and assembled.

More specifically, the first back pressure valve may include a first valve body that is slidably inserted into the first back pressure hole to close the first back pressure hole, and a first communication groove recessed into an outer circumferential surface of the first valve body in the axial direction to communicate with the first back pressure hole. The second back pressure valve may include a second valve body that is slidably inserted into the second back pressure hole to block the second back pressure hole, and a second communication groove recessed into an outer circumferential surface of the second valve body in the axial direction to communicate with the second back pressure hole. This may simplify the first back pressure valve and the second back pressure valve while facilitating refrigerant movement and/or refrigerant movement restriction between the compression chamber and the back pressure chamber.

At least one of the first back pressure valve or the second back pressure valve may be disposed in the non-orbiting scroll. This may reduce a dead volume in the compression chamber, thereby enhancing compression efficiency. More specifically, the first back pressure valve and the second back pressure valve may be disposed in the non-orbiting scroll.

At least one of the first back pressure valve or the second back pressure valve may be disposed in the back pressure chamber assembly. More specifically, the first back pressure valve and the second back pressure valve may be disposed in the back pressure chamber assembly.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing having a low-pressure portion and a high-pressure portion;

an orbiting scroll coupled to a rotary shaft in the low-pressure portion of the casing to perform an orbiting motion;

a non-orbiting scroll engaged with the orbiting scroll to form compression chambers and movable relative to the orbiting scroll in an axial direction of the scroll compressor;

a back pressure chamber assembly disposed at a rear surface of the non-orbiting scroll to form a back pressure chamber;

a first back pressure valve disposed between a first compression chamber of the compression chambers and the back pressure chamber to allow movement of a refrigerant from the first compression chamber to the back pressure chamber while blocking reverse movement of the refrigerant; and a second back pressure valve disposed between the back pressure chamber and a second compression chamber of the compressor chambers and spaced apart from the first back pressure valve, to allow movement of the refrigerant from the back pressure chamber to the second compression chamber while blocking reverse movement of the refrigerant, wherein the first back pressure valve provides communication with the first compression chamber having a relatively lower pressure than a pressure of the second compression chamber, the second back pressure valve providing communication with the second compression chamber, and wherein the second back pressure valve is disposed at a position within a range in which the second compression chamber executes a discharge stroke.

2. The scroll compressor of claim 1, wherein the first back pressure valve is disposed at a position after the first compression chamber completes a suction stroke.

3. The scroll compressor of claim 1, wherein the first back pressure valve is disposed in a first back pressure hole that provides communication between the first compression chamber and the back pressure chamber, the first back pressure valve opening and closing the first back pressure hole according to a pressure difference between the first compression chamber and the back pressure chamber, wherein the second back pressure valve is disposed in a second back pressure hole that provides communication between the back pressure chamber and the second compression chamber, the second back pressure valve opening and closing the second back pressure hole according to a pressure difference between the second compression chamber and the back pressure chamber, and wherein the first back pressure hole and the second back pressure hole are spaced apart by a predetermined rotational angle in a direction in which the compression chambers are formed.

4. The scroll compressor of claim 3, wherein the non-orbiting scroll comprises a non-orbiting wrap forming the compression chambers together with an orbiting wrap of the orbiting scroll, and wherein at least one of the first back pressure hole or the second back pressure hole is formed between outer and inner surfaces of the non-orbiting wrap to be eccentric to one of the outer and inner surfaces.

5. The scroll compressor of claim 3, wherein the first back pressure hole is formed within a range of a suction start angle to 250°, and wherein the second back pressure hole is formed within a range of 255° to a discharge completion angle.

6. The scroll compressor of claim 3, wherein the first back pressure valve is slidably inserted into the first back pressure hole to open and close the first back pressure hole, wherein the second back pressure valve is slidably inserted into the second back pressure hole to open and close the second back pressure hole, and wherein the first back pressure valve and the second back pressure valve are symmetrical to each other.

7. The scroll compressor of claim 6, wherein the first back pressure valve comprises a first valve body that is slidably inserted into the first back pressure hole to close the first back pressure hole, and at least one first communication groove recessed into an outer circumferential surface of the first valve body in the axial direction to communicate with the first back pressure hole, and wherein the second back pressure valve comprises a second valve body that is slidably inserted into the second back pressure hole to block the second back pressure hole, and at least one second communication groove recessed into an outer circumferential surface of the second valve body in the axial direction to communicate with the second back pressure hole.

8. The scroll compressor of claim 3, wherein at least one of the first back pressure valve or the second back pressure valve is disposed in the non-orbiting scroll.

9. The scroll compressor of claim 8, wherein the first back pressure valve and the second back pressure valve are disposed in the non-orbiting scroll.

10. The scroll compressor of claim 3, wherein at least one of the first back pressure valve or the second back pressure valve is disposed in the back pressure chamber assembly.

11. The scroll compressor of claim 10, wherein the first back pressure valve and the second back pressure valve are disposed in the back pressure chamber assembly.

12. A scroll compressor, comprising:

a casing having a low-pressure portion and a high-pressure portion;

an orbiting scroll coupled to a rotary shaft in the low-pressure portion of the casing to perform an orbiting motion;

a non-orbiting scroll engaged with the orbiting scroll to form compression chambers and movable relative to the orbiting scroll in an axial direction of the scroll compressor;

a back pressure chamber assembly disposed at a rear surface of the non-orbiting scroll to form a back pressure chamber;

a first back pressure unit disposed between a first compression chamber of the compression chambers and the back pressure chamber to allow movement of a refrigerant from the first compression chamber to the back pressure chamber while blocking reverse movement of the refrigerant, the first back pressure unit comprising a first back pressure valve, the first back pressure valve including a first valve body that is slidably inserted into a first back pressure hole provided between the first compression chamber and the back pressure chamber to close the first back pressure hole, and a plurality of first communication grooves recessed into an outer circumferential surface of the first valve body in the axial direction to communicate with the first back pressure hole; and a second back pressure unit disposed between the back pressure chamber and a second compression chamber of the compressor chambers and spaced apart from the back pressure chamber, to allow movement of the refrigerant from the back pressure chamber to the second compression chamber while blocking reverse movement of the refrigerant, the second back pressure unit comprising a second back pressure valve, the second back pressure valve including a second valve body that is slidably inserted into a second back pressure hole provided between the second compression chamber and the back pressure chamber to block the second back pressure hole, and a plurality of second communication grooves recessed into an outer circumferential surface of the second valve body in the axial direction to communicate with the second back pressure hole.

13. The scroll compressor of claim 12, wherein the first back pressure unit and the second back pressure unit communicate with compression chambers each having a different pressure.

14. The scroll compressor of claim 12, wherein the first back pressure unit communicates with the first compression chamber having a relatively lower pressure than a pressure of the second compression chamber communicating with the second back pressure unit.

15. The scroll compressor of claim 14, wherein the first back pressure unit is disposed at a position after the first compression chamber completes a suction stroke.

16. The scroll compressor of claim 15, wherein the second back pressure unit is disposed at a position within a range in which the second compression chamber executes a discharge stroke.

17. The scroll compressor of claim 12, wherein the first back pressure valve and the second back pressure valve are disposed in one of the non-orbiting scroll or the back pressure chamber assembly.

18. A scroll compressor, comprising:

a casing having a low-pressure portion and a high-pressure portion;

an orbiting scroll coupled to a rotary shaft in the low-pressure portion of the casing to perform an orbiting motion;

a non-orbiting scroll engaged with the orbiting scroll to form compression chambers and movable relative to the orbiting scroll in an axial direction of the scroll compressor;

a back pressure chamber assembly disposed at a rear surface of the non-orbiting scroll to form a back pressure chamber;

a first back pressure unit disposed between a first compression chamber of the compression chambers and the back pressure chamber to allow movement of a refrigerant from the first compression chamber to the back pressure chamber while blocking reverse movement of the refrigerant; and a second back pressure unit disposed between the back pressure chamber and a second compression chamber of the compressor chambers and spaced apart from the first back pressure unit, to allow movement of the refrigerant from the back pressure chamber to the second compression chamber while blocking reverse movement of the refrigerant, wherein the second back pressure unit communicates with the second compression chamber having a relatively higher pressure than a pressure of the first compression chamber communicating with the first back pressure unit, wherein the first back pressure unit comprises a first back pressure hole that provides communication between the first compression chamber and the back pressure chamber, and a first back pressure valve that opens and closes the first back pressure hole according to a pressure difference between the first compression chamber and the back pressure chamber, wherein the second back pressure unit comprises a second back pressure hole that provides communication between the back pressure chamber and the second compression chamber, and a second back pressure valve that opens and closes the second back pressure hole according to a pressure difference between the second compression chamber and the back pressure chamber, and wherein the first back pressure hole and the second back pressure hole are spaced apart by a predetermined rotational angle in a direction in which the compression chambers are formed.

* * * * *